US011701906B2

(12) United States Patent
Sato et al.

(10) Patent No.: US 11,701,906 B2
(45) Date of Patent: Jul. 18, 2023

(54) RECORDING DEVICE

(71) Applicant: SEIKO EPSON CORPORATION, Tokyo (JP)

(72) Inventors: Koji Sato, Shiojiri (JP); Yuichi Washio, Shiojiri (JP); Katsuya Asamoto, Matsumoto (JP); Shuhei Nishizawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/451,560

(22) Filed: Oct. 20, 2021

(65) Prior Publication Data

US 2022/0126613 A1 Apr. 28, 2022

(30) Foreign Application Priority Data

Oct. 23, 2020 (JP) ..... 2020-178015

(51) Int. Cl.
*B41J 29/17* (2006.01)
*B41J 11/00* (2006.01)

(52) U.S. Cl.
CPC ..... *B41J 29/17* (2013.01); *B41J 11/007* (2013.01)

(58) Field of Classification Search
CPC ..... B41J 29/17; B41J 11/007; B41J 15/048; B41J 2/16544; B41J 13/0009; B41J 2/16535; B41J 2002/1655
See application file for complete search history.

(56) References Cited

U.S. PATENT DOCUMENTS

2011/0242152 A1* 10/2011 Takeda ..... B41J 29/17 347/1
2014/0063122 A1 3/2014 Kanemoto
2015/0130882 A1* 5/2015 Ishizuka ..... B41J 29/17 347/104

FOREIGN PATENT DOCUMENTS

JP 2011-073813 A 4/2011
JP 2014-047034 A 3/2014

* cited by examiner

*Primary Examiner* — Jannelle M Lebron
(74) *Attorney, Agent, or Firm* — Workman Nydegger

(57) ABSTRACT

A recording device includes a recording unit configured to perform recording on a medium, a transporting belt configured to transport the medium, a wiper configured to wipe an outer circumferential surface of the transporting belt by coming into contact with the outer circumferential surface, a holding portion configured to hold the wiper, a support portion configured to support the holding portion such that the wiper is movable toward the outer circumferential surface, an elastic member configured to bias the holding portion such that the wiper comes into contact with the outer circumferential surface while the holding portion is supported movably by the support portion, and a fixing portion configured to fix the holding portion to the support portion.

11 Claims, 19 Drawing Sheets

RECORDING DEVICE

The present application is based on, and claims priority from JP Application Serial Number 2020-178015, filed Oct. 23, 2020, the disclosure of which is hereby incorporated by reference herein in its entirety.

BACKGROUND

1. Technical Field

The present disclosure relates to a recording device.

2. Related Art

In the related art, as exemplified in JP-A-2011-73813, an ink jet recording device as an example of a recording device including a wiping blade that wipes ink attached to an outer circumferential surface of an endless belt has been known. The wiping blade is biased by a spring in a contact direction with the outer circumferential surface of the endless belt.

However, as in the recording device described in JP-A-2011-73813, when contact of the wiping blade with the outer circumferential surface of the endless belt is performed through biasing by the spring, a contact state of the wiping blade with the outer circumferential surface of the endless belt may become unstable.

SUMMARY

A recording device includes a recording unit configured to perform recording on a medium, a transporting belt having an outer circumferential surface that supports the medium, and configured to transport the medium, a wiper configured to wipe the outer circumferential surface by coming into contact with the outer circumferential surface, a holding portion configured to hold the wiper, a support portion configured to support the holding portion movably in a movement direction in which the wiper moves toward the outer circumferential surface, an elastic member configured to bias the holding portion such that the wiper comes into contact with the outer circumferential surface while the holding portion is supported movably in the movement direction by the support portion, and a fixing portion configured to fix the holding portion to the support portion.

DESCRIPTION OF EXEMPLARY EMBODIMENTS

1. First Exemplary Embodiment

Figure 1:
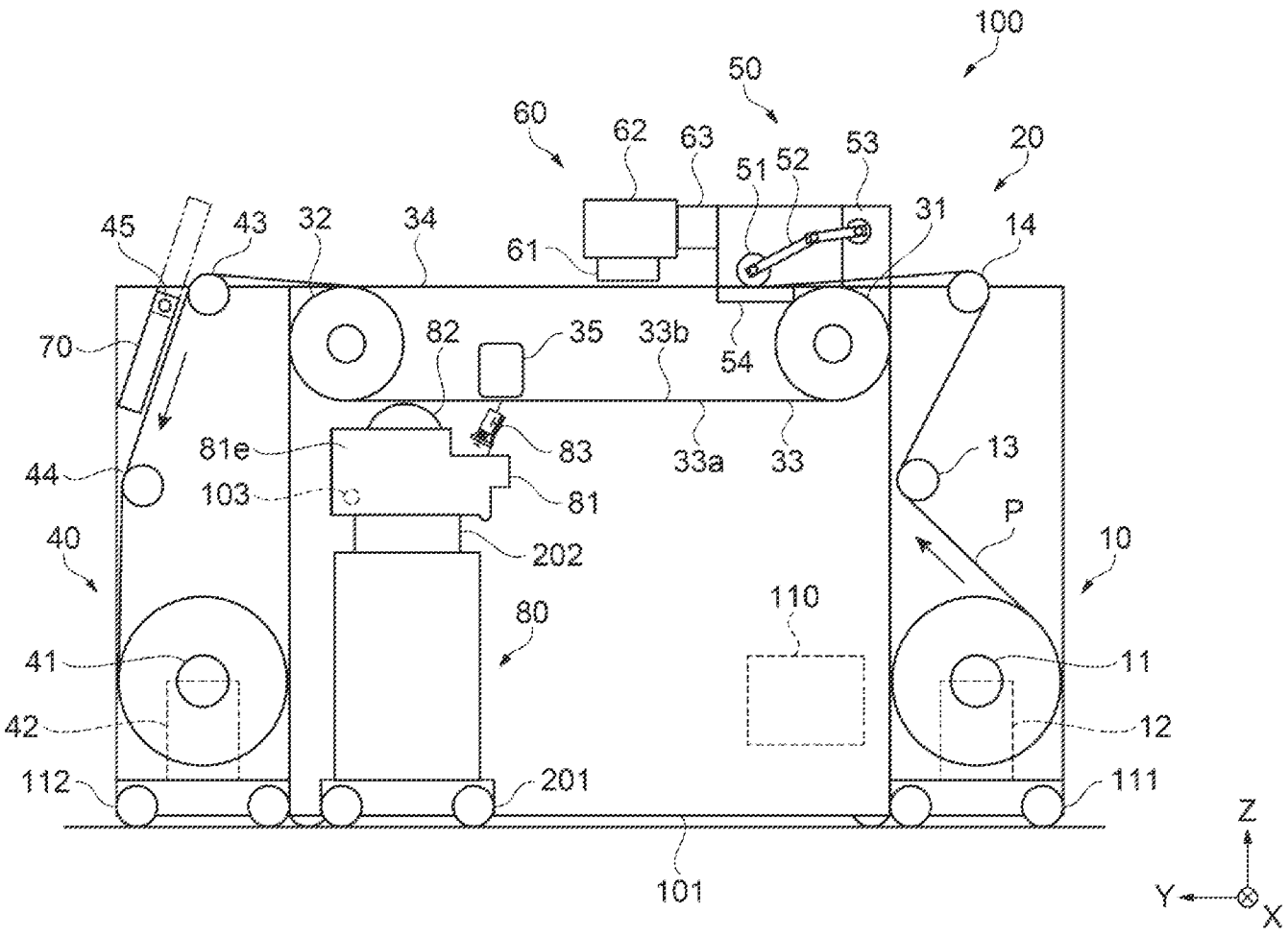
FIG. 1 is a schematic side view illustrating a schematic configuration of a recording device according to a first exemplary embodiment.

A schematic configuration of a recording device 100 according to a first exemplary embodiment will be described with reference to FIG. 1. In the present exemplary embodiment, an ink jet-type recording device 100 that performs printing on a medium P by recording an image and the like on the medium P will be exemplified. Note that, in coordinates illustrated in the drawings, a direction along the gravity is a Z-axis, and a direction along a horizontal plane is indicated by an X-axis and a Y-axis. An upper direction along the gravity is a +Z direction. A transport direction of the medium P facing a recording unit 60 substantially matches a +Y direction along the Y-axis. A width direction of the medium P is a direction along the X-axis. Here, a direction of an arrow is positive in directions along the X-axis, the Y-axis, and the Z-axis.

As illustrated in FIG. 1, the recording device 100 includes a medium transport unit 20, a medium contact unit 50, the recording unit 60, a drying unit 70, a cleaning unit 80, and a control unit 110 that controls each of the units. Each of the units of the recording device 100 is fixed or positioned on a body frame 101.

The medium transport unit 20 transports the medium P in an arrow direction illustrated in FIG. 1 along a transport path. The medium transport unit 20 includes a medium supply unit 10, a transporting belt 33, a belt rotating roller 31, a belt driving roller 32, and a medium collection unit 40. First, the transport path for the medium P from the medium supply unit 10 to the medium collection unit 40 will be described.

The medium supply unit 10 supplies the medium P to the transporting belt 33. As the medium P, there can be used, for example, natural fiber, cotton, silk, hemp, mohair, wool, cashmere, regenerated fiber, synthetic fiber, nylon, polyurethane, polyester, and woven cloth or non-woven cloth fabricated by mixed spinning of these fibers. To the woven cloth or the non-woven cloth, a pretreatment agent for promoting a color developing property and a fixing property may be applied.

The medium supply unit 10 includes a supply shaft unit 11 in which the medium P having a band shape is wound in a roll shape, a bearing unit 12 that detachably and rotatably supports both ends of the supply shaft unit 11 having a cylindrical shape, a rotation driving unit (not illustrated) that rotationally drives the supply shaft unit 11, a first supply roller 13, a second supply roller 14, and a caster 111. The rotation driving unit is, for example, an electric motor. The rotation driving unit is rotationally driven to rotate the supply shaft unit 11, and thus the medium P is fed. The first supply roller 13 and the second supply roller 14 relay, to the transporting belt 33, the medium P fed from the medium supply unit 10. The medium supply unit 10 is detachably fixed to the body frame 101 from a −Y direction side that is the rear of the recording device 100 and the transporting belt 33.

The transporting belt 33 can transport the medium P facing the recording unit 60 in the transport direction. In the transporting belt 33, both end portions of the belt having a band shape are coupled to each other to form in an endless manner. The transporting belt 33 is hung between the belt rotating roller 31 and the belt driving roller 32. The transporting belt 33 is held in a state where a predetermined tension is applied thereto. An outer circumferential surface 33*a* of the transporting belt 33 is provided with an adhesive layer 34 onto which the medium P adheres. The transporting belt 33 supports the medium P in contact with the adhesive layer 34 by the medium contact unit 50 described later. This allows stretchable clothes and the like to be handled as the medium P.

The belt rotating roller 31 and the belt driving roller 32 are provided inside the transporting belt 33, and support an inner circumferential surface 33*b* of the transporting belt 33. The belt driving roller 32 includes a rotation driving unit that rotationally drives the belt driving roller 32. The belt driving roller 32 is rotationally driven, and the transporting belt 33 is rotationally moved, and thus the belt rotating roller 31 is driven by rotation. In this way, the medium P supported by the transporting belt 33 is transported in the transport direction, and an image is formed on the medium P by the recording unit 60 provided between the belt rotating roller 31 and the belt driving roller 32.

Note that a support member that supports the inner circumferential surface 33*b* being a portion of the transporting belt 33 facing the recording unit 60 may be configured to be provided between the belt rotating roller 31 and the belt driving roller 32. Further, the transporting belt 33 including the adhesive layer 34 that brings the medium P into contact is described, but, for example, the transporting belt 33 may be an electrostatic adsorption-type transporting belt that adsorbs a medium by static electricity.

The medium collection unit 40 collects the medium P. The medium collection unit 40 includes a first collection roller 43, the drying unit 70, a second collection roller 44, a winding shaft unit 41 that winds the medium P in a roll shape, a bearing unit 42 that detachably and rotatably supports both ends of the winding shaft unit 41 having a cylindrical shape, a rotation driving unit that rotationally drives the winding shaft unit 41, and a caster 112.

The first collection roller 43 removes, from the transporting belt 33, the medium P on which an image is formed. The first collection roller 43 and the second collection roller 44 relay the removed medium P to the winding shaft unit 41. The rotation driving unit is rotationally driven to rotate the winding shaft unit 41, and thus the medium P is wound. The medium collection unit 40 is detachably fixed to the body frame 101 from the +Y direction side that is the front of the recording device 100 and the transporting belt 33.

Next, each unit provided along the transport path of the medium P will be described.

The medium contact unit 50 is provided upstream of the recording unit 60 in the transport direction, and causes the medium P supplied onto the transporting belt 33 to come into contact with the adhesive layer 34. The medium contact unit 50 includes a press roller 51 formed in a cylindrical shape, a roller support unit 52 that rotatably supports both ends of the press roller 51, a roller receiving unit 54 that receives a load of the press roller 51 via the transporting belt 33, and a press roller driving unit 53 that drives the press roller 51. The press roller driving unit 53 moves the press roller 51 in the transport direction and a direction opposite to the transport direction. In this way, the medium P is pressed by the load of the press roller 51 to be in contact with the adhesive layer 34.

The recording unit 60 is disposed above the transporting belt 33, and performs recording on the medium P on the transporting belt 33. The recording unit 60 includes a head 61, a carriage 62 on which the head 61 is mounted, and a guide rail 63 that supports the carriage 62. The head 61 includes a plurality of nozzles constituting a nozzle row and an actuator that discharges ink from the nozzle. Ink such as cyan, magenta, yellow, and black is supplied to each nozzle row.

The guide rail 63 is a rail extending along the X-axis, and supports the carriage 62 such that the carriage 62 can reciprocate along the width direction of the medium P.

The recording unit 60 includes a movement mechanism for moving the carriage 62 and a power source that drives the movement mechanism. As the movement mechanism, for example, a mechanism including a combination of a ball screw and a ball nut, a linear guide mechanism, and the like are employed. As the power source, for example, a variety of motors such as a stepping motor, a servomotor, and a linear motor are employed.

The drying unit 70 is rotatably provided on an attachment shaft 45 of the medium collection unit 40. The drying unit 70 is movable between a drying position indicated by a solid line in FIG. 1 and a maintenance position indicated by a two-dot chain line. The drying unit 70 is provided upstream of the winding shaft unit 41 in the transport direction, and dries the medium P removed from the transporting belt 33. The drying unit 70 includes, for example, a far-infrared heater, and is driven by the far-infrared heater in the drying position to dry ink that permeates the medium P in a short time. In this way, the medium P on which recording was performed can be wound onto the winding shaft unit 41.

The cleaning unit 80 is disposed between the belt driving roller 32 and the belt rotating roller 31, and cleans, from below in a gravitational direction, the outer circumferential surface 33*a* of the transporting belt 33 after the medium P is removed. The cleaning unit 80 includes a cleaning tank 81, a cleaning brush 82, a wiper unit 83, a rotation driving unit that rotationally drives the cleaning brush 82, a caster 201, and an elevator mechanism 202. With the medium collection unit 40 removed from the body frame 101, the cleaning unit 80 is guided from the +Y direction side that is the front of the recording device 100 and the transporting belt 33 to a guide rail (not illustrated) that guides the cleaning unit 80 movably in the Y direction. Then, the cleaning unit 80 is inserted below the outer circumferential surface 33*a* of the transporting belt 33, and is positioned on the body frame 101.

Figure 2:
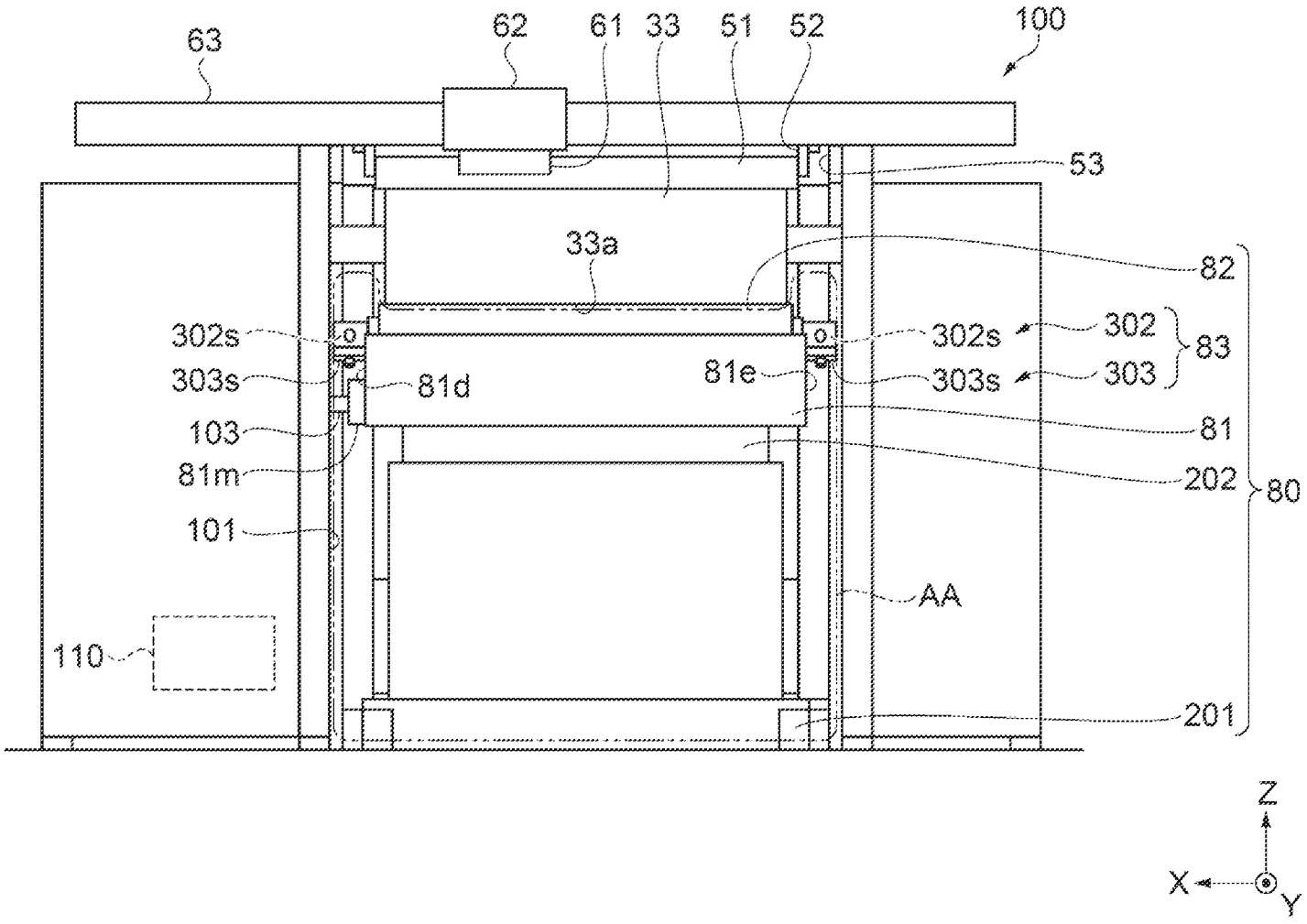
FIG. 2 is a schematic front view illustrating a schematic configuration of the recording device according to the first exemplary embodiment.
Figure 3A:
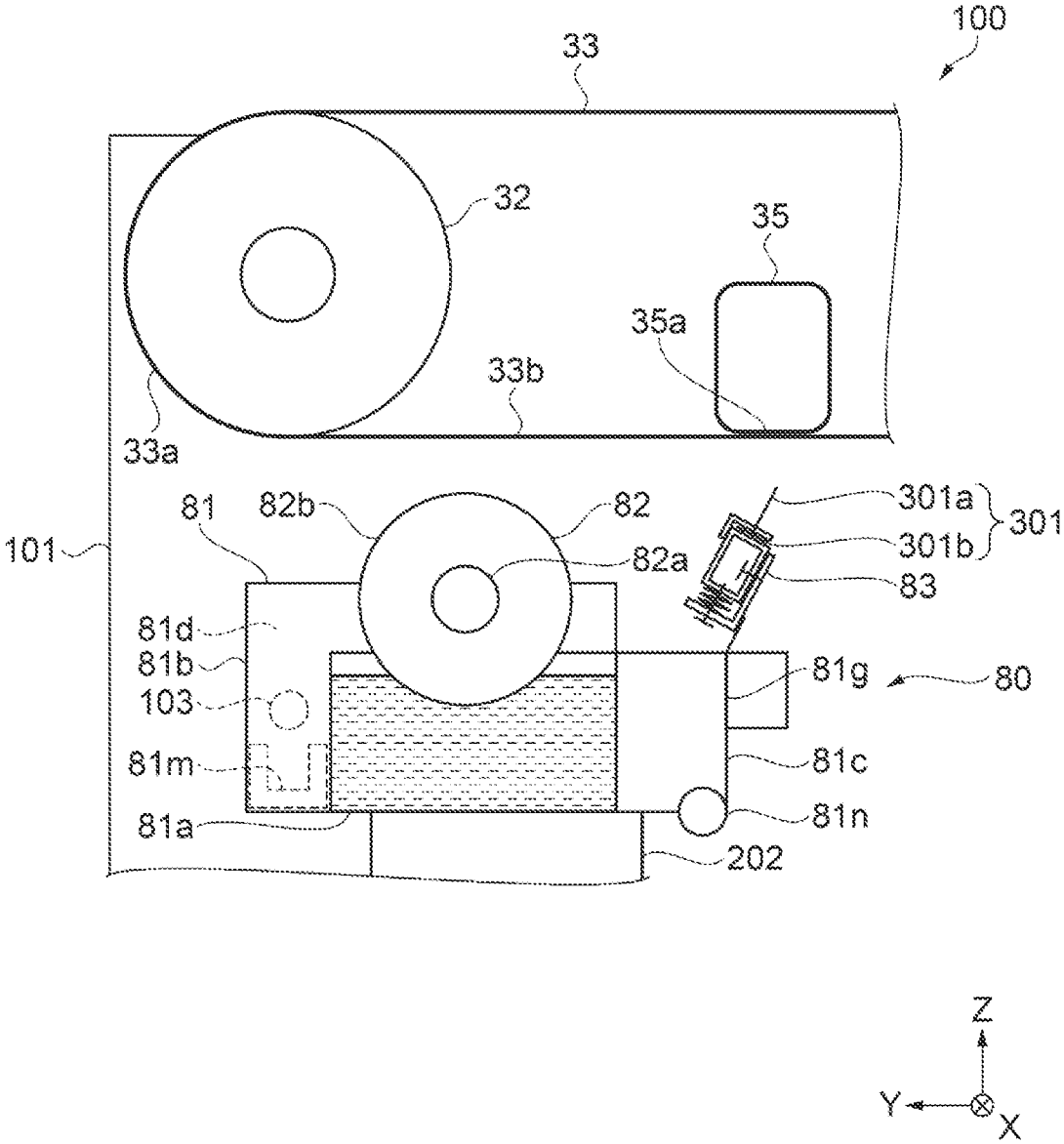
FIG. 3A is a schematic side view illustrating a periphery of a cleaning tank in a separated position.
Figure 3B:
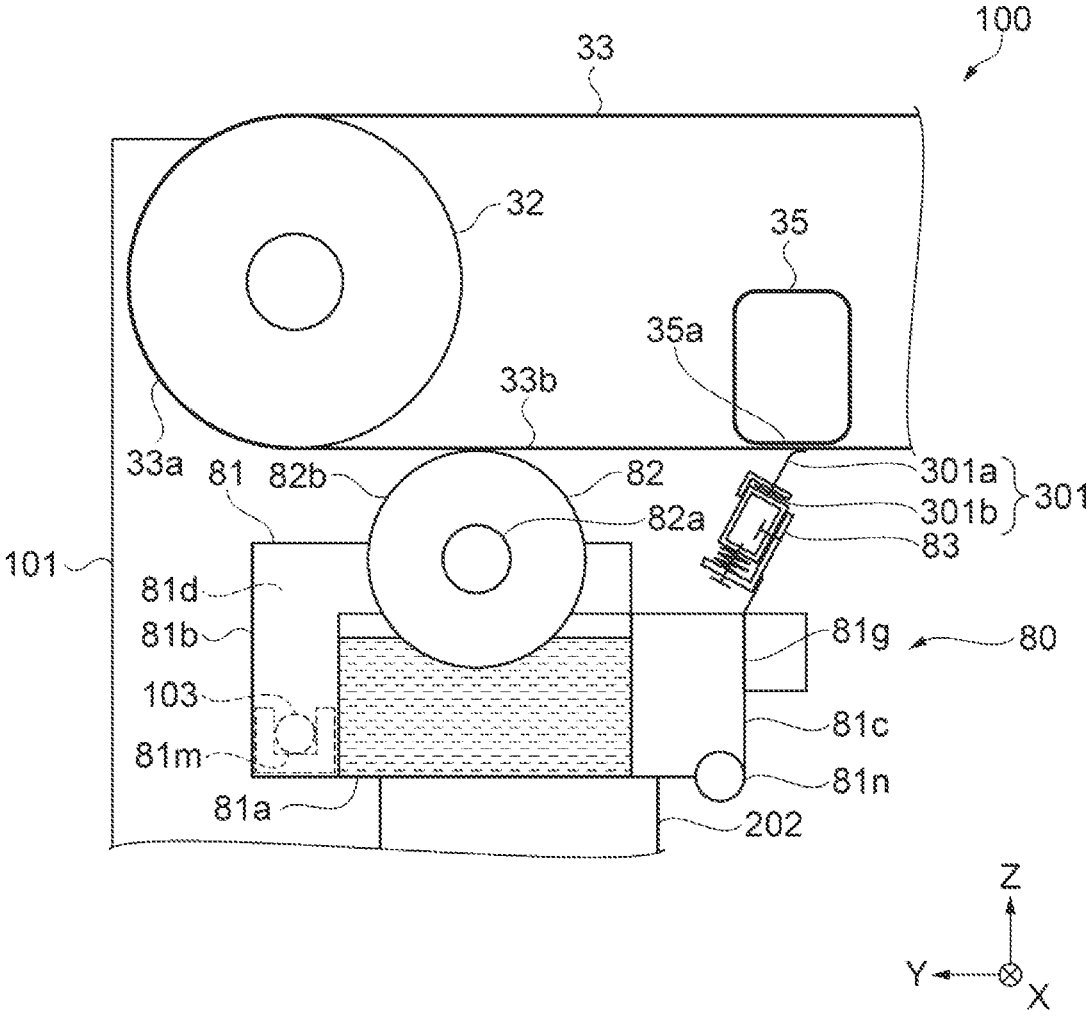
FIG. 3B is a schematic side view illustrating the periphery of the cleaning tank in a cleaning position.

As illustrated in FIGS. 2 to 3B, the cleaning tank 81 is a tank that stores a cleaning liquid. As the cleaning liquid, for example, water and a water-soluble solvent such an alcoholic aqueous solution may be used, and a surfactant agent and an anti-foaming agent may be added as necessary. The cleaning tank 81 includes a bottom wall 81*a*, a front wall 81*b*, a rear wall 81*c*, a side wall 81*d*, and a side wall 81*e* facing the side wall 81*d*. The side wall 81*d* is provided with a first positioning portion 81*m*. The bottom wall 81*a* is provided with a waste liquid discharge portion 81*n*. The rear wall 81*c* is provided with a plate member 81*g*.

The cleaning brush 82 includes a shaft unit 82*a* having a cylindrical shape and extending in an X direction, and a brush 82*b* provided on an outer circumferential surface of the shaft unit 82*a*. The brush 82*b* is formed by bundling a plurality of bristles, and extends radially from the outer circumferential surface of the shaft unit 82*a* when viewed from the X direction with a rotary shaft of the shaft unit 82*a* as the center. Note that, in the drawings, an outline in which a tip of the brush 82*b* is lined up throughout the entire circumference is indicated by a circle. The cleaning brush 82 is rotatably supported inside the cleaning tank 81 such that an upper portion thereof protrudes from the cleaning tank 81. In a cleaning position illustrated in FIG. 3B in which the brush 82*b* and the outer circumferential surface 33*a* of the transporting belt 33 are in contact with each other, the cleaning brush 82 is rotated, and ink, fiber of fabric, and the like attached to the outer circumferential surface 33*a* of the transporting belt 33 are removed.

As illustrated in FIGS. 3A and 3B, the wiper unit 83 includes a wiper 301 that can wipe the outer circumferential surface 33*a* of the transporting belt 33 by contacting the outer circumferential surface 33*a* of the transporting belt 33. The wiper 301 includes a wiping portion 301*a* and a base portion 301*b*. The wiper 301 is formed of an elastic member having elasticity such as silicone rubber. The wiper 301 is located downstream of the cleaning brush 82 in a movement direction of the outer circumferential surface 33*a* in contact with the wiper 301, and is provided in the cleaning tank 81 such that at least the wiping portion 301*a* of the wiper 301 protrudes from the cleaning tank 81. The wiping portion 301*a* is provided so as to extend in the X direction across a width of the transporting belt 33. An extending direction in which the wiping portion 301*a* extends from the base portion 301*b* toward the outer circumferential surface 33*a* of the transporting belt 33 is inclined with respect to the movement direction of the outer circumferential surface 33*a* in contact with the wiper 301. In other words, a tip of the wiping portion 301*a* is inclined so as to be located downstream of a rear end of the wiping portion 301*a* on the base portion 301*b* side in the movement direction of the outer circumferential surface 33*a* in contact with the wiper 301. In the cleaning position in which the wiping portion 301*a* of the wiper 301 and the outer circumferential surface 33*a* of the transporting belt 33 are in contact with each other, the transporting belt 33 rotates, and thus the wiping portion 301*a* of the wiper 301 and the outer circumferential surface 33*a* of the transporting belt 33 slide, and the cleaning liquid remaining on the outer circumferential surface 33*a* of the transporting belt 33 is removed. The removed cleaning liquid is collected in a waste liquid collection unit and the like outside the cleaning tank 81 via the waste liquid discharge portion 81*n* in the cleaning tank 81.

Note that, in the cleaning position illustrated in FIG. 3B, a belt support portion 35 is provided inside a portion of the transporting belt 33 in contact with the wiping portion 301*a* of the wiper 301. The belt support portion 35 is provided so as to extend in the X direction in the recording device 100, and supports the inner circumferential surface 33*b* of the transporting belt 33 by a support surface 35*a*. In this way, displacement of the transporting belt 33 in an inner direction of the transporting belt 33 due to a pressing load from the wiper 301 can be suppressed.

The elevator mechanism 202 moves the cleaning tank 81, the cleaning brush 82, and the wiper unit 83 up and down in the Z direction. The cleaning tank 81, the cleaning brush 82, and the wiper unit 83 is movable, by an elevator operation of the elevator mechanism 202, between the cleaning position in which the brush 82*b* and the wiping portion 301*a* of the wiper 301 are in contact with the outer circumferential surface 33*a* of the transporting belt 33, and a separated position in which the brush 82*b* and the wiping portion 301*a* of the wiper 301 are separated from the outer circumferential surface 33*a* of the transporting belt 33.

In the cleaning position, a movement in the +Z direction and the Y direction of the first positioning portion 81*m* formed on the side wall 81*d* of the cleaning tank 81 is restricted by a first positioning pin 103 provided on the body frame 101, and thus a position of the brush 82*b* and the wiping portion 301*a* is defined with respect to the outer circumferential surface 33*a* of the transporting belt 33.

Figure 4A:
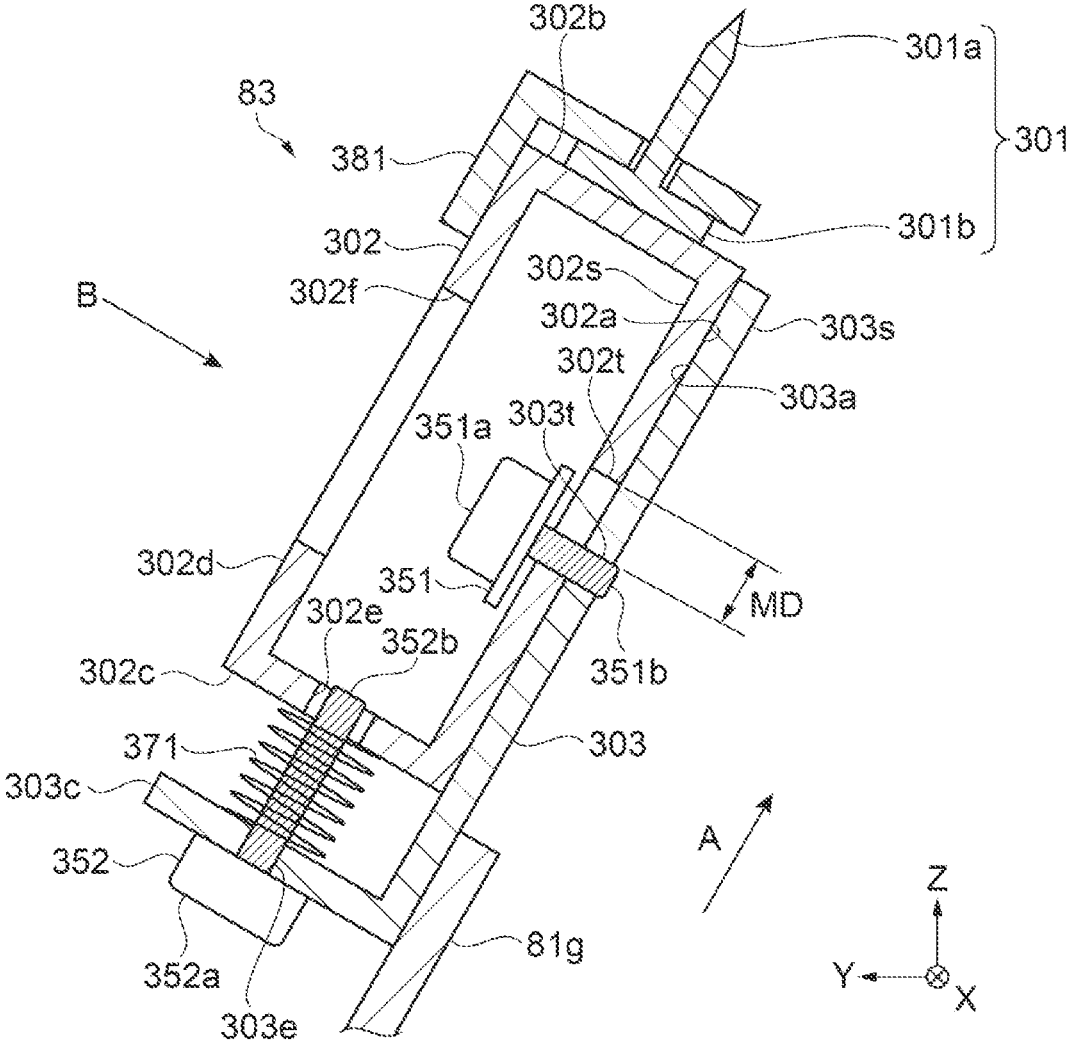
FIG. 4A is a schematic cross-sectional view of a wiper unit according to the first exemplary embodiment.

As illustrated in FIG. 4A, the wiper unit 83 includes a holding portion 302 that holds the wiper 301, a support portion 303 that supports the holding portion 302, at least one fixing screw 351 that can fix the holding portion 302 to the support portion 303, and at least one helical spring 371. The fixing screw 351 is an example of a fixing portion, and the helical spring 371 is an example of an elastic member. The fixing screw 351 is a bolt including a head portion 351*a* and a shaft portion 351*b* with a thread. The head portion 351*a* has a hexagonal hole for rotating the fixing screw 351 about a center axis of the shaft portion 351*b*. Alternatively, a straight groove, a cross hole, and the like may be provided in the head portion 351*a*. Alternatively, the head portion 351*a* may have a hexagonal shape, a setting knob shape, and a lever shape for rotating the fixing screw 351 about the center axis of the shaft portion 351*b*. As in the present exemplary embodiment, the fixing screw 351 may be previously provided, on the head portion 351*a*, with a washer having an outer diameter larger than an outer diameter of the head portion 351*a*. The helical spring 371 is a compression coil spring.

As illustrated in FIG. 4A, the support portion 303 supports the holding portion 302 movably in a movement direction A in which the wiper 301 moves toward the outer circumferential surface 33*a* of the transporting belt 33. The movement direction A is a direction along the extending direction of the wiping portion 301*a*. The support portion 303 is fixed to the plate member 81*g* provided on the rear wall 81*c* of the cleaning tank 81. Note that a direction that intersects the movement direction A and is included in a Y-Z plane is a direction B.

Figure 4B:
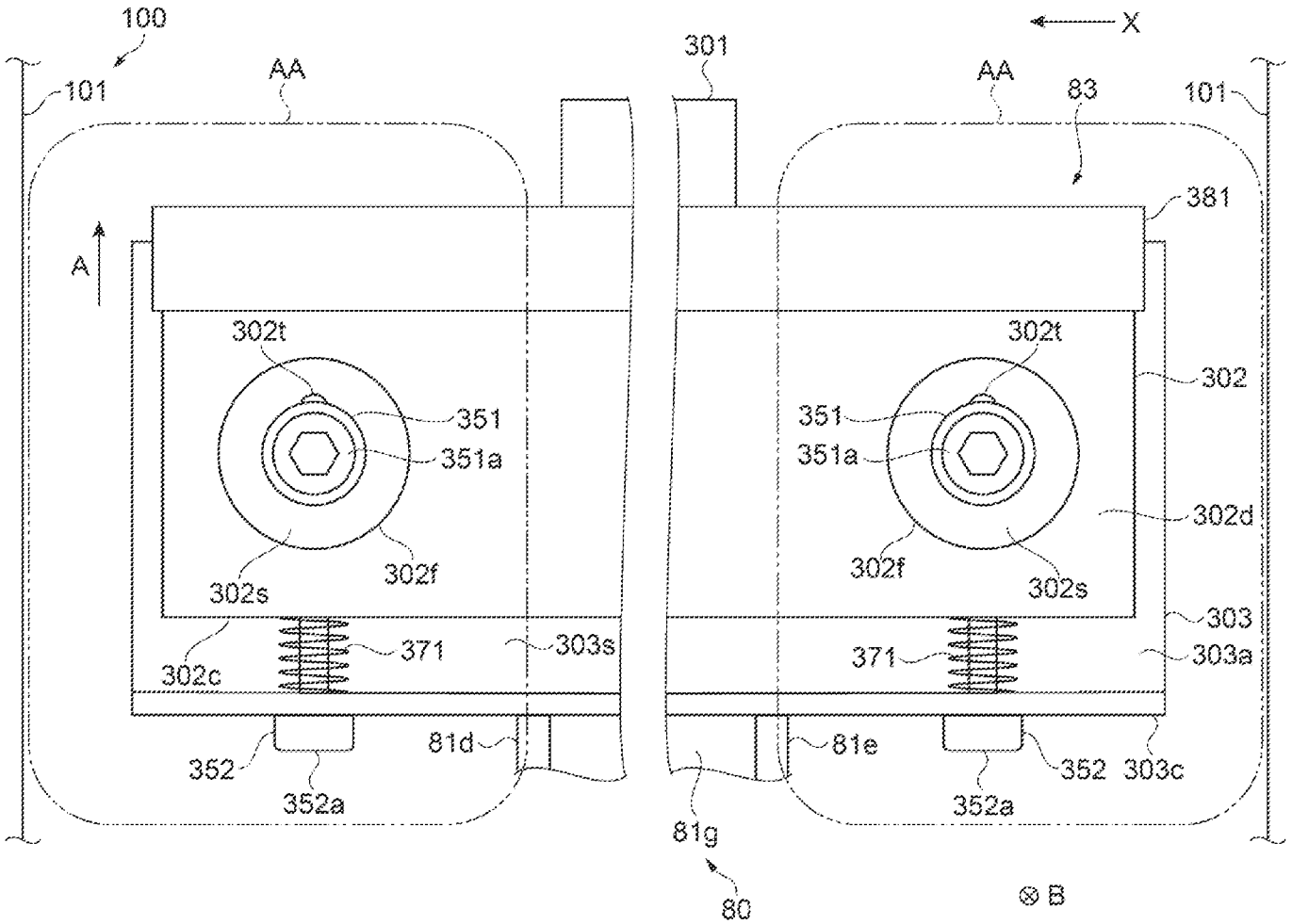
FIG. 4B is a plan view when viewed from a direction B in FIG. 4A.

As illustrated in FIGS. 4A and 4B, the support portion 303 includes an access portion 303*s* located in a +X direction and a −X-axis direction with respect to the side wall 81*d* and the side wall 81*e* of the cleaning tank 81 in a state where the support portion 303 is fixed to the plate member 81*g*. In other words, the access portion 303*s* is located on both outer sides of the cleaning tank 81 in the X direction, and a user can visually recognize the access portion 303*s* from the direction B. As illustrated in FIGS. 2 and 4B, a region on both outer sides of the cleaning tank 81 in which the access portion 303*s* is located is an access region AA accessible by a user from the +Y direction side that is the front of the recording device 100 while the cleaning unit 80 is positioned on the body frame 101 and is located below the outer circumferential surface 33*a* of the transporting belt 33. The access portion 303*s* is provided with an upright portion 303*c* that supports the helical spring 371. A support surface 303*a* that supports the holding portion 302 movably in the movement direction A is provided on at least the access portion 303*s*. The access portion 303*s* has a screw hole 303*t* that extends through the support surface 303*a* in the direction B. The upright portion 303*c* has a second screw hole 303*e* that extends through the upright portion 303*c* in the movement direction A. A second screw 352 is screwed into the second screw hole 303*e*. The second screw 352 is an example of an insertion portion. The second screw 352 is a bolt including a head portion 352*a* and a shaft portion 352*b* with a thread.

As illustrated in FIG. 4A, the holding portion 302 has an angular tube shape, and includes a tip portion 302*b* to which the wiper 301 is attached, a rear end portion 302*c* opposite to the tip portion 302*b* in the movement direction A, a fixed portion 302*s*, and a coupling portion 302*d*. The tip portion 302*b* holds the wiper 301 by an attachment member 381 attached to the holding portion 302 while the base portion 301*b* of the wiper 301 is supported. The rear end portion 302*c* has a through hole 302*e* that extends through the rear end portion 302*c* in the movement direction A. The through hole 302*e* has an outer diameter larger than that of the second screw 352, and has a shape that does not allow the head portion 352*a* to pass through the through hole 302*e*. The outer diameter of the second screw 352 is a diameter of the shaft portion 352*b* of the second screw 352. In other words, when viewed from the movement direction A, the through hole 302*e* has the outer diameter larger than that of the shaft portion 352*b* and smaller than that of the head portion 352*a*.

The fixed portion 302*s* of the holding portion 302 includes a sliding surface 302*a* that slides with respect to the support surface 303*a* of the access portion 303*s* when the holding portion 302 moves in the movement direction A with respect to the support portion 303. The fixed portion 302*s* is located between the tip portion 302*b* and the rear end portion 302*c* in the movement direction A. The fixed portion 302*s* of the holding portion 302 has, in a position corresponding to the screw hole 303*t* of the support portion 303, a through hole 302*t* that extends through the sliding surface 302*a* and the fixed portion 302*s* in the direction B. The through hole 302*t* is an example of a first hole. The through hole 302*t* has an outer diameter larger than that of the fixing screw 351, and has a shape that does not allow the head portion 351*a* to pass through the through hole 302*t*. The outer diameter of the fixing screw 351 is a diameter of the shaft portion 351*b* of the fixing screw 351. In other words, specifically, when viewed from the direction B, the through hole 302*t* has the outer diameter larger than that of the shaft portion 351*b* and smaller than that of the head portion 351*a*. The coupling portion 302*d* couples the tip portion 302*b* and the rear end portion 302*c*. The coupling portion 302*d* has a through hole 302*f* in a position corresponding to the through hole 302*t* of the fixed portion 302*s*. The through hole 302*f* is a hole into which a tool for rotating the fixing screw 351 can be inserted. The fixed portion 302*s* is located in the access region AA accessible from the +Y direction side that is the front of the recording device 100 from which the medium collection unit 40 is removed while the cleaning unit 80 is positioned on the body frame 101 and is located below the outer circumferential surface 33*a* of the transporting belt 33.

The fixing screw 351 is screwed into the screw hole 303*t* provided in the access portion 303*s* of the support portion 303 while the fixing screw 351 is inserted into the through hole 302*t* provided in the fixed portion 302*s*, and thus the fixed portion 302*s* sandwiched between the head portion 351*a* of the fixing screw 351 and the support portion 303 is tightened with respect to the support portion 303 to fix the holding portion 302. In other words, the fixing screw 351 is screwed into the screw hole 303*t* while being inserted into the through hole 302*t*, and thus the holding portion 302 sandwiched between the head portion 351*a* of the fixing screw 351 and the support portion 303 becomes fixed to the support portion 303. At this time, the wiper 301 enters a fixed state where the wiper 301 does not move in the movement direction A. Further, by rotating the fixing screw 351 and loosening the fixing screw 351, the sliding surface 302*a* can slide with respect to the support surface 303*a* as illustrated in FIG. 4A. Then, the holding portion 302 becomes supported movably in the movement direction A by the support portion 303. A moving amount MD in which the holding portion 302 is movable in the movement direction A with respect to the support portion 303 is increased by making the through hole 302*t* larger than the outer diameter of the fixing screw 351. For example, a shape of the through hole 302*t* may have an elongated hole shape in which a dimension in a direction along the movement direction A is larger than a dimension in the X direction being a width direction of the transporting belt 33. In this way, in a state where the fixing screw 351 is loosened, a maximum moving amount of the holding portion 302 in the X direction is smaller than a maximum moving amount of the holding portion 302 in the movement direction A. In other words, in the state where the fixing screw 351 is loosened, a movement of the holding portion 302 in the X direction can be limited. Thus, in the state where the fixing screw 351 is loosened, a position of the holding portion 302 with respect to the support portion 303 in the X direction can be defined by the outer diameter of the fixing screw 351 and the through hole 302*t* formed in the elongated hole shape.

In a support state where the support portion 303 supports the holding portion 302, the upright portion 303*c* is located upstream of the rear end portion 302*c* of the holding portion 302 in the movement direction A. In the support state, the second screw 352 is inserted through the through hole 302*e* of the rear end portion 302*c* from the upright portion 303*c* side along the movement direction A. Further, in the support state, the helical spring 371 is disposed between the upright portion 303*c* and the rear end portion 302*c* in the movement direction A while the second screw 352 is inserted through an inner circumference of the helical spring 371. Thus, the helical spring 371 presses the holding portion 302 in the movement direction A while the holding portion 302 is supported movably in the movement direction A by the support portion 303. In other words, the helical spring 371 biases the holding portion 302 such that the wiping portion 301*a* of the wiper 301 can come into contact with the outer circumferential surface 33*a* of the transporting belt 33 while the holding portion 302 is supported movably in the movement direction A by the support portion 303. In the present exemplary embodiment, in a state where the holding portion 302 is supported movably in the movement direction A by the support portion 303, and the wiping portion 301*a* is not in contact with the outer circumferential surface 33*a* of the transporting belt 33, and also in a state where the fixing screw 351 is loosened, the holding portion 302 moves in the movement direction A by action of the helical spring 371. Then, at a point in time when an upstream end of an inner wall constituting the through hole 302*t* in the movement direction A is pressed against the fixing screw 351, and the inner wall abuts the fixing screw 351, a movement of the holding portion 302 in the movement direction A is restricted. At this time, the wiping portion 301*a* of the wiper 301 is in a movable state where the wiping portion 301*a* is movable by the moving amount MD in a direction opposite to the movement direction A from a position in a restriction state where the movement of the holding portion 302 is restricted.

Figure 5A:
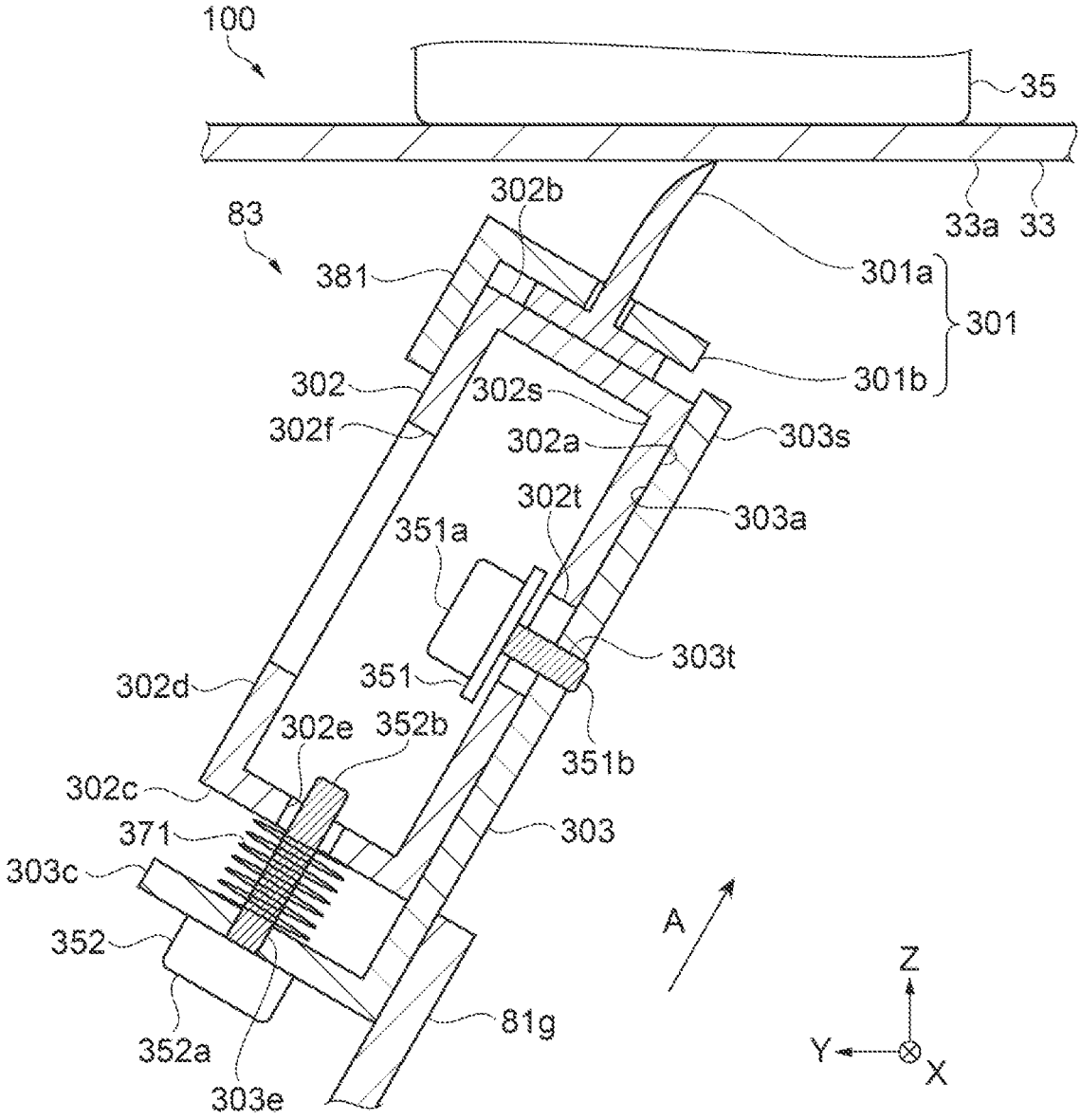
FIG. 5A is a schematic cross-sectional view of the wiper unit according to the first exemplary embodiment in a following wipeable state.

The cleaning unit 80 is disposed below the outer circumferential surface 33*a* of the transporting belt 33, and the control unit 110 drives the elevator mechanism 202, and thus the wiping portion 301*a* of the wiper 301 in the movable state is moved from the separated position to the cleaning position. In this way, as illustrated in FIG. 5A, when the wiping portion 301*a* is in contact with the outer circumferential surface 33*a* of the transporting belt 33 in the cleaning position, the wiping portion 301*a* of the wiper 301 enters a pressed state of being pressed against the outer circumferential surface 33*a* of the transporting belt 33 in the movement direction A by a predetermined load PL.

At this time, when the fixing screw 351 is loosened, in the cleaning position in which the outer circumferential surface 33*a* of the transporting belt 33 can be wiped, the wiping portion 301*a* of the wiper 301 is pressed against the outer circumferential surface 33*a* of the transporting belt 33 in the movement direction A by the predetermined load PL. In this way, the wiping portion 301*a* of the wiper 301 enters a following wipeable state where the wiping portion 301*a* is movable in the movement direction A. In this state, the transporting belt 33 is rotationally moved based on a control signal from the control unit 110, and thus the recording device 100 can perform a following wiping operation of wiping the outer circumferential surface 33*a* of the transporting belt 33 by the wiping portion 301*a* of the wiper 301 in the following wipeable state. Note that the predetermined load PL can be changed by, for example, replacing the helical spring 371 with a helical spring having a specification different from that of the helical spring 371.

Figure 5B:
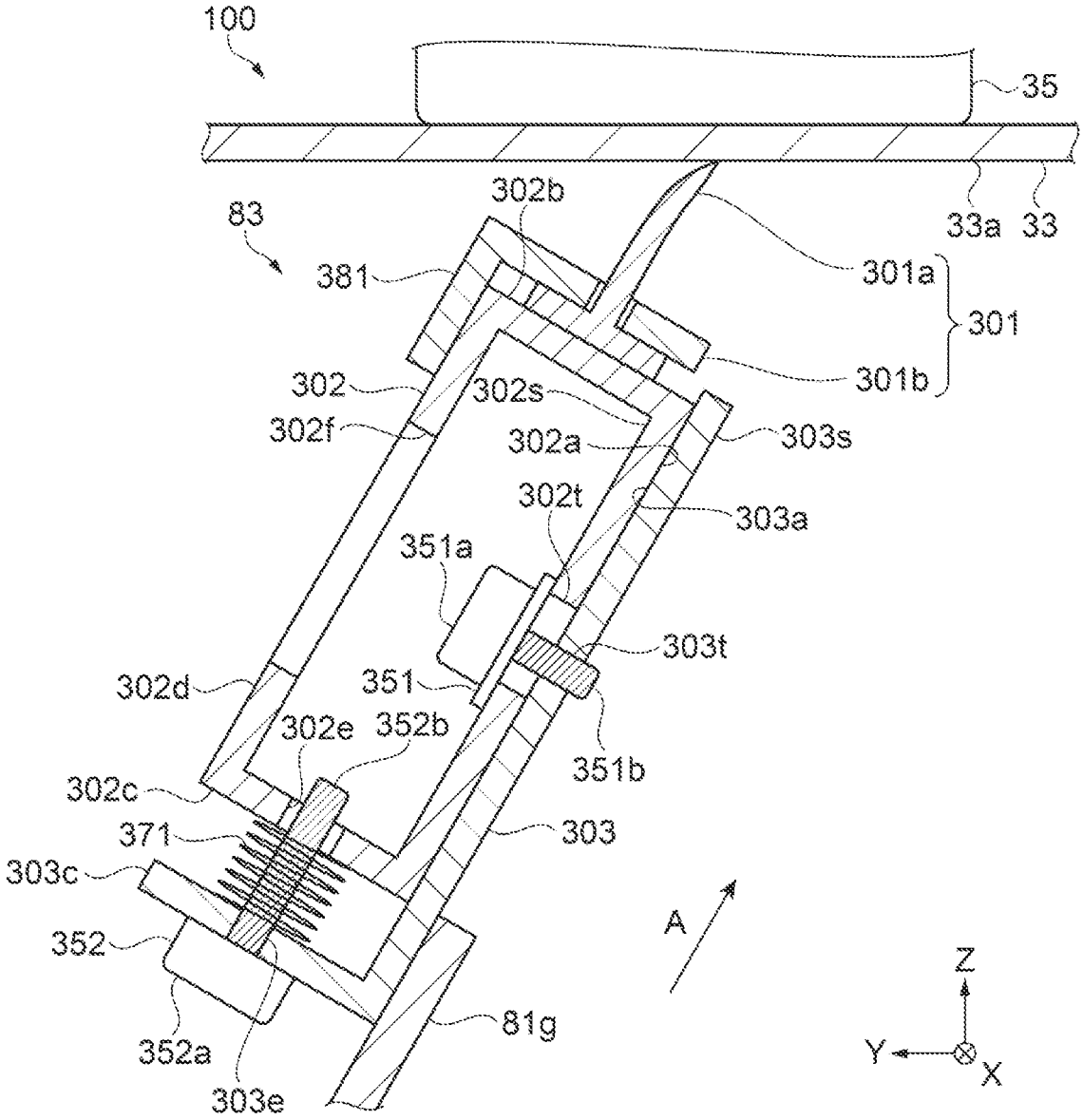
FIG. 5B is a schematic cross-sectional view of the wiper unit according to the first exemplary embodiment in a fixed wipeable state.

Further, in the present exemplary embodiment, the fixed portion 302*s* of the holding portion 302 and the head portion 351*a* of the fixing screw 351 are located in the access region AA accessible from the +Y direction side that is the front of the recording device 100 while the cleaning unit 80 is positioned on the body frame 101 and is located below the outer circumferential surface 33*a* of the transporting belt 33. Thus, the fixed portion 302*s* can be accessed from the front of the recording device 100, and, as illustrated in FIG. 5, the holding portion 302 with the wiping portion 301*a* of the wiper 301 in the pressed state can be tightened and fixed to the support portion 303 by the fixing screw 351. In this way, in the cleaning position in which the outer circumferential surface 33*a* of the transporting belt 33 can be wiped, the wiping portion 301*a* of the wiper 301 is pressed against the outer circumferential surface 33*a* of the transporting belt 33 in the movement direction A by the predetermined load PL. In this way, the wiping portion 301*a* of the wiper 301 enters a fixed wipeable state where the wiping portion 301*a* does not move in the movement direction A. In this state, the transporting belt 33 is rotationally moved based on the control signal from the control unit 110, and thus the recording device 100 can perform a fixed wiping operation of wiping the outer circumferential surface 33*a* of the transporting belt 33 by the wiping portion 301*a* of the wiper 301 in the fixed wipeable state.

When the outer circumferential surface 33*a* of the transporting belt 33 is wiped by rotationally moving the outer circumferential surface 33*a* of the transporting belt 33 while the wiper 301 is biased toward the outer circumferential surface 33*a* of the transporting belt 33 by an elastic member, such as a spring and rubber, and is in contact with the outer circumferential surface 33*a* of the transporting belt 33, vibration, a movement more than necessary, and the like of the wiper 301 may occur due to contact with the outer circumferential surface 33*a* of the moving transporting belt 33. In such a case, a contact state of the wiper 301 with the outer circumferential surface 33*a* of the transporting belt 33 becomes unstable, and the outer circumferential surface 33*a* of the transporting belt 33 may not be wiped in an excellent manner.

The recording device 100 according to the present exemplary embodiment includes the wiper 301 configured to wipe the outer circumferential surface 33*a* by coming into contact with the outer circumferential surface 33*a* of the transporting belt 33, the holding portion 302 configured to hold the wiper 301, the support portion 303 configured to support the holding portion 302 movably in the movement direction A in which the wiper 301 moves toward the outer circumferential surface 33*a*, the helical spring 371 configured to bias the holding portion 302 such that the wiper 301 comes into contact with the outer circumferential surface 33*a* while the holding portion 302 is supported movably in the movement direction A by the support portion 303, and the fixing screw 351 configured to fix the holding portion 302 to the support portion 303. According to this configuration, when the contact state of the wiper 301 with the outer circumferential surface 33*a* by the elastic member is unstable, fixing the holding portion 302 to the support portion 303 by the fixing screw 351 can reduce instability of the contact state of the wiper 301 with the outer circumferential surface 33*a*, and the outer circumferential surface 33*a* can be wiped.

Figure 6:
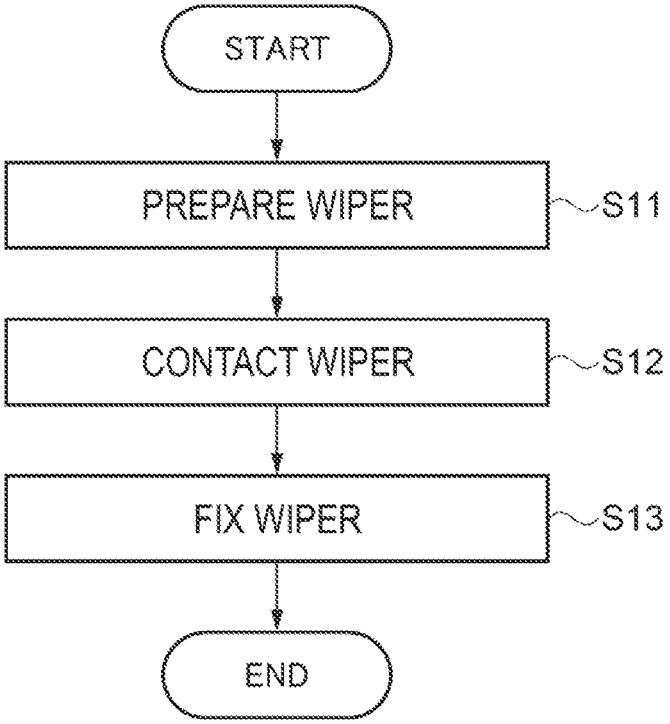
FIG. 6 is a flowchart illustrating an example of a method for adjusting a wiper.

Next, an example of a method for adjusting the wiper 301 according to the present exemplary embodiment will be described by using FIG. 6. First, in step S11, wiper preparation in which the holding portion 302 is made movable in the movement direction A with respect to the support portion 303 to cause the wiping portion 301*a* of the wiper 301 to be in the movable state is performed. The wiper preparation may be performed with the cleaning unit 80 disposed below the outer circumferential surface 33*a* of the transporting belt 33, and may be performed with the cleaning unit 80 removed from the recording device 100.

In step S12, while the cleaning unit 80 is inserted from the +Y direction side that is the front of the recording device 100 and the transporting belt 33 into the recording device 100 in which the medium collection unit 40 is removed, and the cleaning unit 80 is disposed below the outer circumferential surface 33*a* of the transporting belt 33, the elevator mechanism 202 is driven to perform wiper contact in which the cleaning tank 81 moves from the separated position to the cleaning position. By performing the wiper contact, the wiping portion 301*a* of the wiper 301 in the movable state comes into contact with the outer circumferential surface 33*a* of the transporting belt 33, and is disposed in the cleaning position. At this time, the wiping portion 301*a* of the wiper 301 is pressed against the outer circumferential surface 33*a* of the transporting belt 33 in the movement direction A by the predetermined load PL, and is also in the following wipeable state where the wiping portion 301*a* is movable in the movement direction A.

In step S13, in the cleaning position in which the wiping portion 301*a* of the wiper 301 is in the pressed state against the outer circumferential surface 33*a* of the transporting belt 33, wiper fixing in which the holding portion 302 is tightened and fixed to the support portion 303 is performed by tightening the fixing screw 351. By performing the wiper fixing, in the cleaning position in which the outer circumferential surface 33*a* of the transporting belt 33 can be wiped, the wiping portion 301*a* of the wiper 301 is pressed against the outer circumferential surface 33*a* of the transporting belt 33 in the movement direction A by the predetermined load PL, and also enters the fixed wipeable state where the wiping portion 301*a* does not move in the movement direction A.

According to the present exemplary embodiment, the following effect can be obtained.

The recording device 100 includes the recording unit 60 configured to perform recording on the medium P, the transporting belt 33 having the outer circumferential surface 33*a* that supports the medium P, and configured to transport the medium P, the wiper 301 configured to wipe the outer circumferential surface 33*a* by coming into contact with the outer circumferential surface 33*a* of the transporting belt 33, the holding portion 302 configured to hold the wiper 301, the support portion 303 configured to support the holding portion 302 movably in the movement direction A in which the wiper 301 moves toward the outer circumferential surface 33*a*, the elastic member configured to bias the holding portion 302 such that the wiper 301 comes into contact with the outer circumferential surface 33*a* while the holding portion 302 is supported movably in the movement direction A by the support portion 303, and the fixing portion configured to fix the holding portion 302 to the support portion 303. According to this configuration, when the contact state of the wiper 301 with the outer circumferential surface 33*a* by the elastic member is unstable, fixing the holding portion 302 to the support portion 303 by the fixing portion can reduce instability of the contact state of the wiper 301 with the outer circumferential surface 33*a*, and the outer circumferential surface 33*a* can be wiped.

The support portion 303 includes the support surface 303*a* along the movement direction A, the holding portion 302 includes the sliding surface 302*a* that slides with respect to the support surface 303*a*, the support surface 303*a* has the screw hole 303*t*, the holding portion 302 has the through hole 302*t* that extends through the sliding surface 302*a* and the holding portion 302 in the direction B, and the fixing portion is the fixing screw 351, and the holding portion 302 sandwiched between the head portion 351*a* of the fixing screw 351 and the support portion 303 is fixed to the support portion 303 by screwing the fixing screw 351 into the screw hole 303*t* while the fixing screw 351 is inserted through the through hole 302*t* larger than an outer diameter of the fixing screw 351. According to this configuration, by loosening the fixing screw 351 screwed into the screw hole 303*t* while the fixing screw 351 is inserted through the through hole 302*t*, a state where the holding portion 302 is fixed to the support portion 303 can be brought into a state where the holding portion 302 is supported movably in the movement direction by the support portion 303.

The holding portion 302 includes the rear end portion 302*c* opposite to the tip portion 302*b* to which the wiper 301 is attached in the movement direction A, the support portion 303 includes the upright portion 303*c* provided upstream of the rear end portion 302*c* in the movement direction A, and the elastic member is disposed between the upright portion 303*c* and the rear end portion 302*c* in the movement direction A. According to this configuration, by disposing the elastic member between the upright portion 303*c* and the rear end portion 302*c* in the movement direction A, a configuration in which the elastic member can bias the holding portion 302 in the movement direction A can be easily formed.

The elastic member is the helical spring 371, and the upright portion 303*c* is provided with the insertion portion inserted through the inner circumference of the helical spring 371. According to this configuration, a position of the helical spring 371 with respect to the upright portion 303*c* can be defined. Further, disengagement of the helical spring 371 from the disposed position between the upright portion 303*c* and the rear end portion 302*c* can be suppressed.

The insertion portion is the second screw 352 configured to be screwed into the second screw hole 303*e* provided in the upright portion 303*c*. According to this configuration, by removing the second screw 352 as the insertion portion from the upright portion 303*c*, the elastic member can be removed. The helical spring 371 can be replaced without completely removing the holding portion 302 from the support portion 303. When the helical spring 371 is replaced, a state where a tip of the second screw 352 is screwed into the upright portion 303*c* can be maintained, and thus the second screw 352 accidentally falling can be suppressed.

The rear end portion 302*c* has the through hole 302*e* through which the insertion portion is inserted. According to this configuration, interference of the insertion portion with the rear end portion 302*c* can be suppressed. Further, disengagement of the helical spring 371 from the disposed position between the upright portion 303*c* and the rear end portion 302*c* can be further suppressed.

2. Second Exemplary Embodiment

In a recording device 400 according to a second exemplary embodiment, the body frame 101 and the cleaning unit 80 according to the above-described first exemplary embodiment are changed to a body frame 401 and a cleaning unit 480. Note that the same components as in the first exemplary embodiment are given the same reference signs, and redundant descriptions of these components will be omitted.

Figure 7:
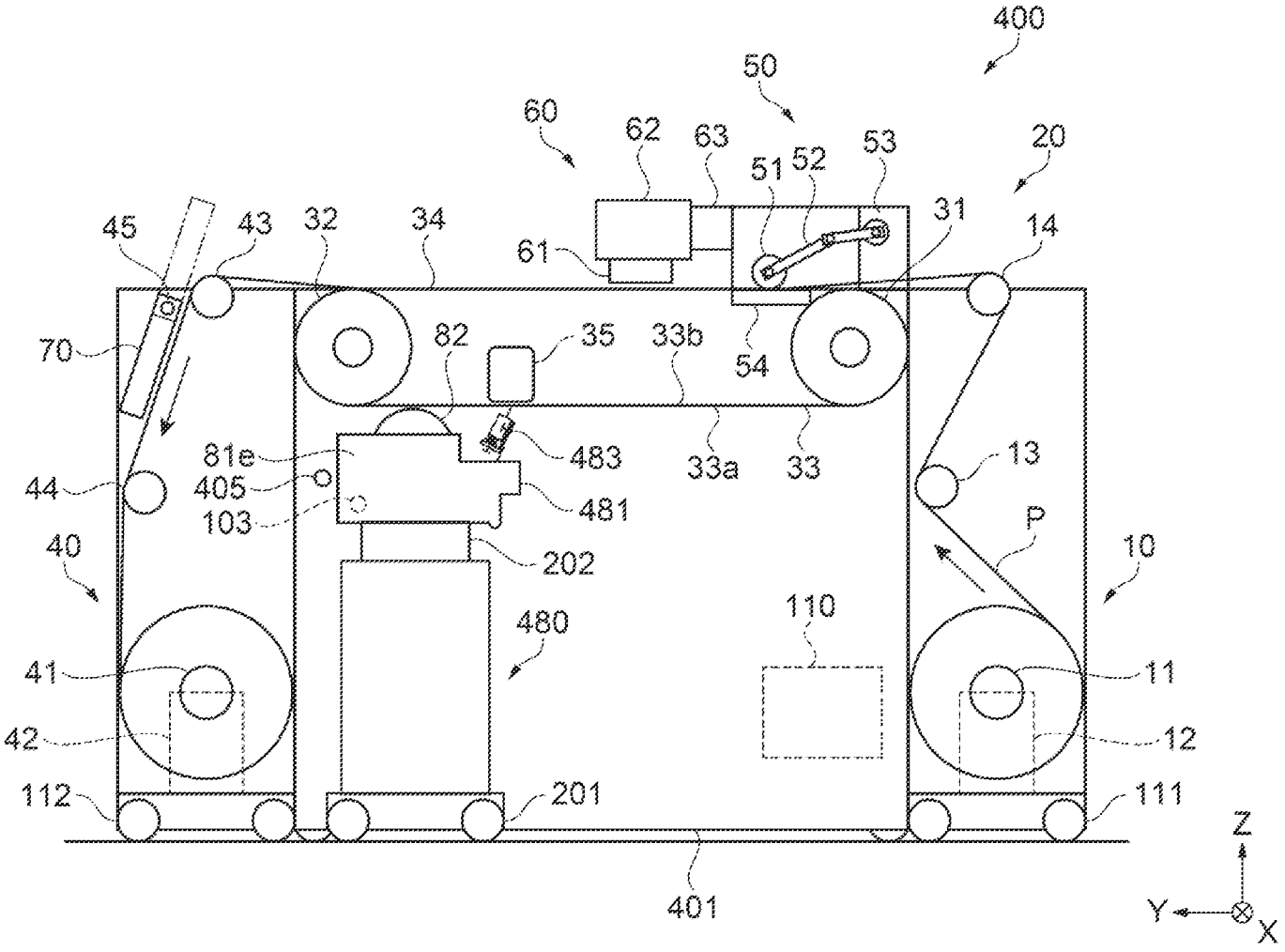
FIG. 7 is a schematic side view illustrating a schematic configuration of a recording device according to a second exemplary embodiment.

As illustrated in FIG. 7, the body frame 401 is obtained by adding a second positioning pin 405 to the body frame 101 according to the first exemplary embodiment. The second positioning pin 405 positions a cleaning tank 481 in an adjustment position described later. The second positioning pin 405 is movable in the X direction between a retraction position in which the second positioning pin 405 is not in contact with the cleaning tank 481, and a protruding position in which the second positioning pin 405 protrudes from the body frame 401 in a −X direction and positions the cleaning tank 481 in the adjustment position. In the cleaning unit 480, the cleaning tank 81 and the wiper unit 83 of the cleaning unit 80 according to the first exemplary embodiment are changed to the cleaning tank 481 and a wiper unit 483.

Figure 8A:
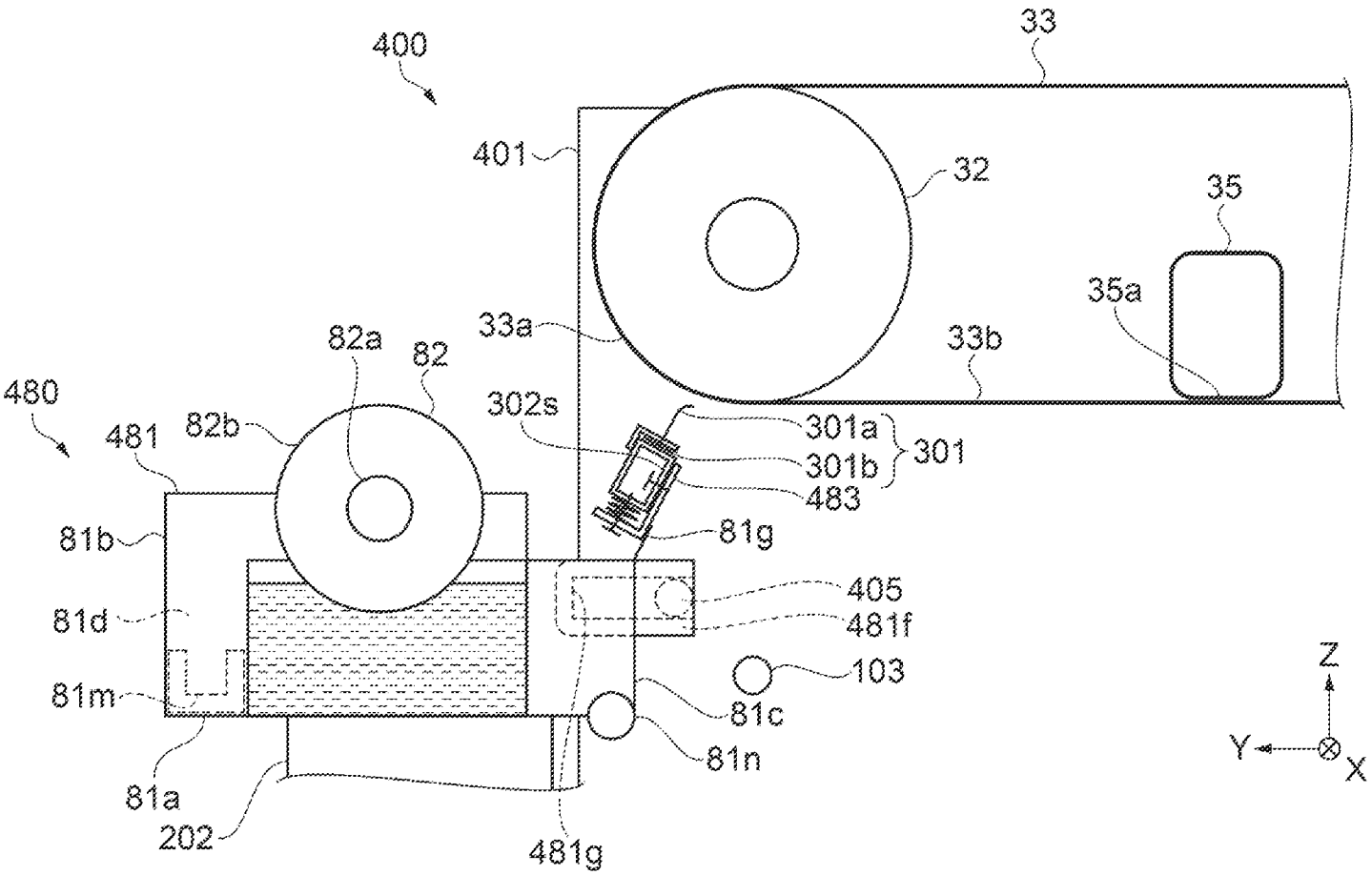
FIG. 8A is a schematic side view of a periphery of a cleaning unit during guide.
Figure 8B:
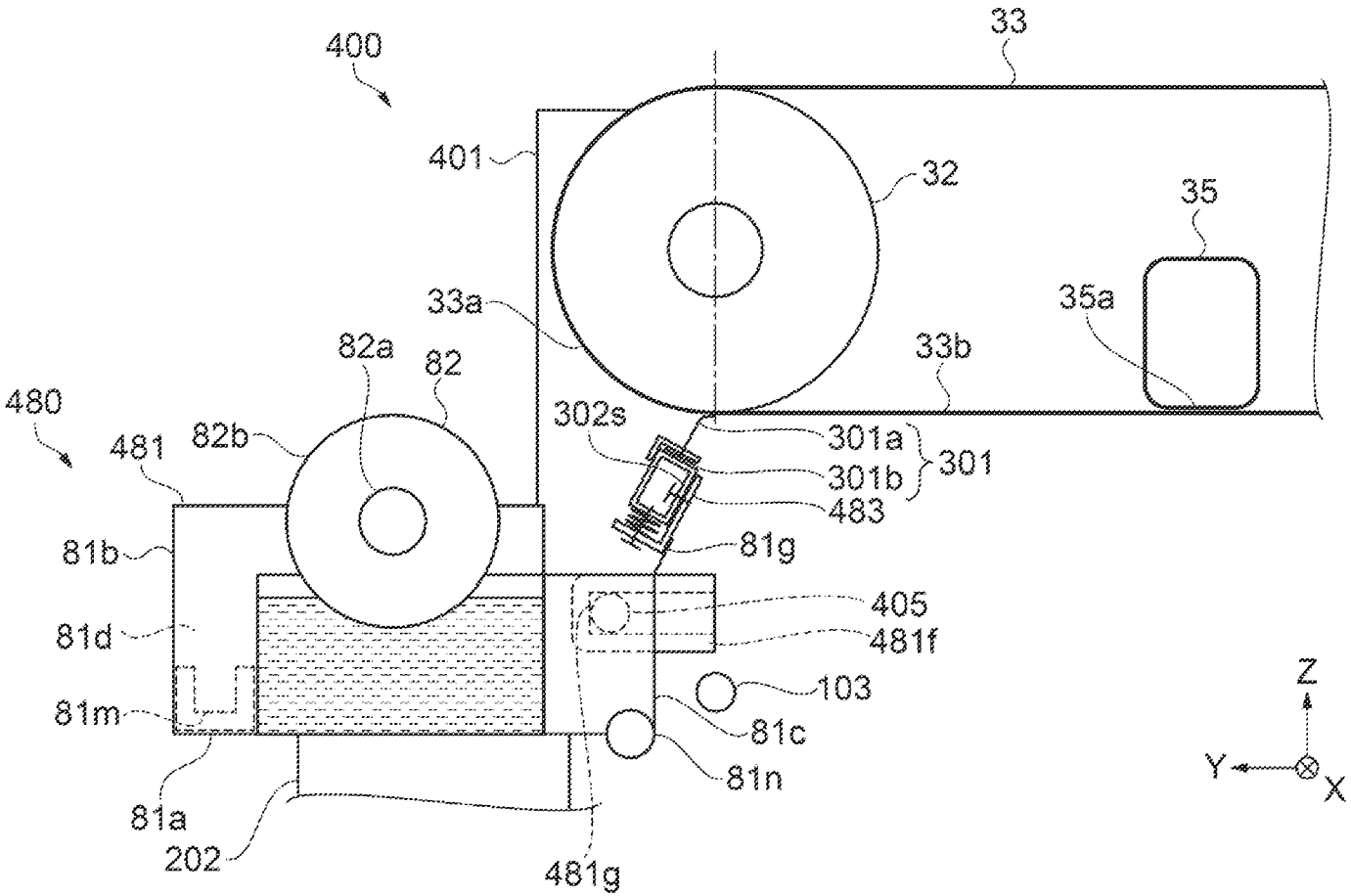
FIG. 8B is a schematic side view of the periphery of the cleaning unit in an adjustment position.

As illustrated in FIGS. 8A and 8B, the cleaning tank 481 is obtained by adding a second positioning portion 481*f* to the cleaning tank 81 according to the first exemplary embodiment. The second positioning portion 481*f* is provided on the side wall 81*d* of the cleaning tank 481. A positioning end portion 481*g* is provided on the +Y direction side that is the front of the recording device 400 in the second positioning portion 481*f*. In a state where the medium collection unit 40 is removed from the body frame 401 and the second positioning pin 405 of the body frame 401 is located in the protruding position, the cleaning unit 480 is inserted from the +Y direction side that is the front of the recording device 400 into the recording device 400 that is in the −Y direction while the cleaning unit 480 is guided by a guide rail (not illustrated). Then, as illustrated in FIG. 8A, in the cleaning tank 481, the second positioning portion 481*f* is guided by the second positioning pin 405, and a movement in the Z direction is restricted. When the cleaning unit 480 is further inserted in the −Y direction, as illustrated in FIG. 8B, the positioning end portion 481*g* comes into contact with the second positioning pin 405, a movement in the −Y direction is restricted, and the cleaning tank 481 is positioned in the adjustment position.

In the adjustment position illustrated in FIG. 8B, as indicated by a dot chain line in the drawing, a portion of the transporting belt 33 in contact with the wiping portion 301*a* of the wiper 301 is located vertically below the center of rotation of the belt driving roller 32, and the inner circumferential surface 33*b* of the transporting belt 33 is supported from the inside by the belt driving roller 32. Further, the adjustment position is set such that a distance in the Z direction between the outer circumferential surface 33*a* of the transporting belt 33 in contact with the wiping portion 301*a* of the wiper 301 in the adjustment position, and the cleaning tank 481 in the adjustment position is the same as a distance in the Z direction between the outer circumferential surface 33*a* of the transporting belt 33 in contact with the wiping portion 301*a* of the wiper 301 in the cleaning position, and the cleaning tank 481 in the cleaning position. Further, when the cleaning tank 481 is located in the adjustment position, a front surface region of the wiper unit 483 that includes the access portion 303*s* and the fixed portion 302*s* and that is located on the front side of the recording device 400 is accessible from the +Y direction side that is the front of the recording device 400. According to this configuration, the recording device 400 according to the present exemplary embodiment can perform, in the adjustment position, the wiper fixing in the method for adjusting the wiper 301 with substantially the same adjustment accuracy as that when the wiper fixing is performed in the cleaning position.

Figure 9A:
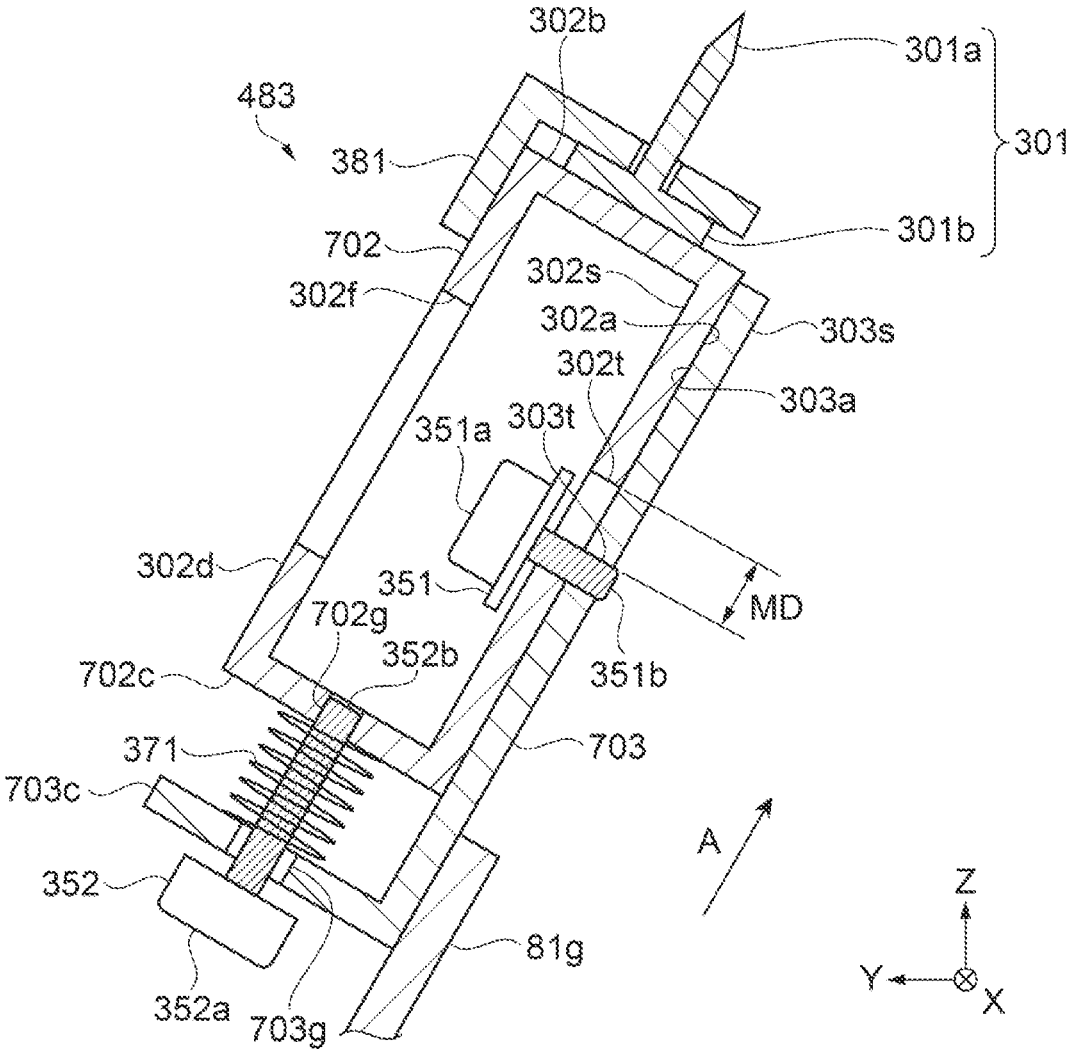
FIG. 9A is a schematic cross-sectional view of a wiper unit according to the second exemplary embodiment.

As illustrated in FIG. 9A, in the wiper unit 483, the holding portion 302 and the support portion 303 of the wiper unit 83 according to the first exemplary embodiment are changed to a holding portion 702 and a support portion 703. In the holding portion 702, the rear end portion 302*c* of the holding portion 302 according to the first exemplary embodiment is changed to a rear end portion 702*c*. In the rear end portion 702*c*, the through hole 302*e* of the rear end portion 302*c* according to the first exemplary embodiment is changed to a screw hole 702*g*. In the support portion 703, the upright portion 303*c* of the support portion 303 according to the first exemplary embodiment is changed to an upright portion 703*c*. In the upright portion 703*c*, the second screw hole 303*e* of the upright portion 303*c* according to the first exemplary embodiment is changed to a through hole 703*g*. The through hole 703*g* has an outer diameter larger than that of the second screw 352, and has a shape that does not allow the head portion 352*a* of the second screw 352 to pass through the through hole 703*a*.

In a support state where the support portion 703 supports the holding portion 702, the upright portion 703*c* is located upstream of the rear end portion 702*c* of the holding portion 702 in the movement direction A. In the support state, the second screw 352 is inserted through the through hole 703*g* of the upright portion 703*c* along the movement direction A, and is screwed into the screw hole 702*g* of the rear end portion 702*c*. Further, in the support state, the helical spring 371 is disposed between the upright portion 703*c* and the rear end portion 702*c* in the movement direction A while the second screw 352 is inserted through the inner circumference of the helical spring 371. Thus, the helical spring 371 presses the holding portion 702 in the movement direction A while the holding portion 702 is supported movably in the movement direction A by the support portion 703. In other words, the helical spring 371 biases the holding portion 702 such that the wiping portion 301*a* of the wiper 301 can come into contact with the outer circumferential surface 33*a* of the transporting belt 33 while the holding portion 702 is supported movably in the movement direction A by the support portion 703.

Then, in a state where the holding portion 702 is supported movably in the movement direction A by the support portion 703, and the wiping portion 301*a* is not in contact with the outer circumferential surface 33*a* of the transporting belt 33, and also in a state where the fixing screw 351 is loosened, the holding portion 702 moves in the movement direction A by the helical spring 371. Then, at a point in time when the upstream end of the inner wall constituting the through hole 302*t* in the movement direction A is pressed against the fixing screw 351, and the inner wall abuts the fixing screw 351, a movement of the holding portion 302 in the movement direction A is restricted. At this time, the wiping portion 301*a* of the wiper 301 is in the movable state where the wiping portion 301*a* is movable by the moving amount MD in the direction opposite to the movement direction A from a position in the restriction state where the movement of the holding portion 302 is restricted. At this time, as illustrated in FIG. 9A, the head portion 352*a* of the second screw 352 is not in contact with the upright portion 703*c*, and a gap is provided between the head portion 352*a* and the upright portion 703*c*.

Figure 9B:
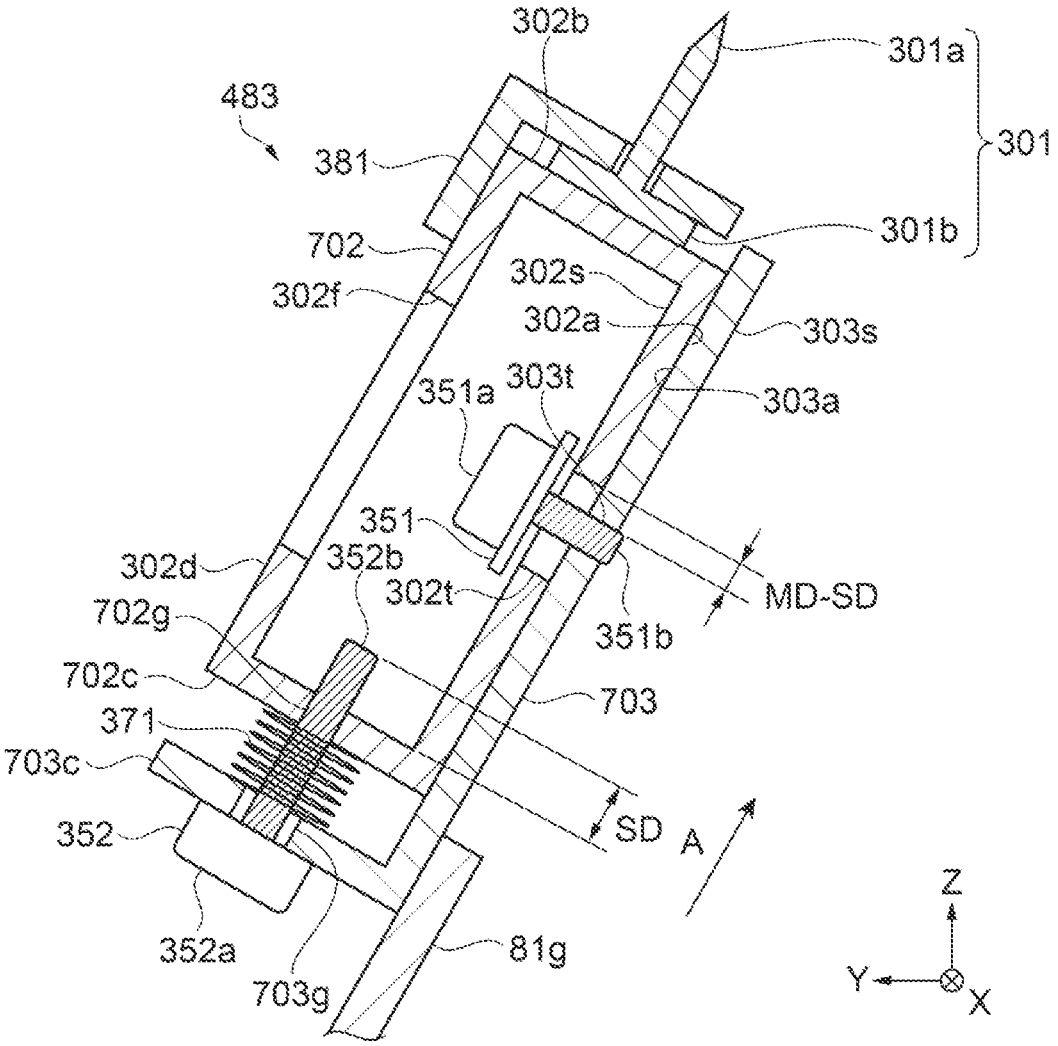
FIG. 9B is a schematic cross-sectional view according to an adjustment of a moving amount of a wiper.

In the present exemplary embodiment, after the head portion 352*a* of the second screw 352 is caused to come into contact with the upright portion 703*c* by screwing the second screw 352 into the screw hole 702*g* from this state, as illustrated in FIG. 9B, the second screw 352 is further screwed into the screw hole 702*g* by a screw amount SD, and thus the wiping portion 301*a* of the wiper 301 can be moved by the screw amount SD in the direction opposite to the movement direction A from the position in the restriction state. In other words, in the present exemplary embodiment, by changing the screw amount of the second screw 352 into the screw hole 702*g*, a position of the wiping portion 301*a* of the wiper 301 in the movable state can be adjusted in the direction along the movement direction A.

Further, in the present exemplary embodiment, in the support state where the support portion 703 supports the holding portion 702, the second screw 352 is inserted through the inner circumference of the helical spring 371, and is screwed into the screw hole 702*g* of the rear end portion 702*c*. According to this configuration, in the support state, when the fixing screw 351 is removed, the holding portion 702 that holds the wiper 301 and the helical spring 371 are less likely to come off the support portion 703.

The method for adjusting the wiper 301 according to the present exemplary embodiment performs, in the adjustment position, the wiper contact and the wiper fixing performed in the cleaning position in the first exemplary embodiment. Further, as necessary, by changing the screw amount of the second screw 352 into the screw hole 702*g* before the wiper fixing is performed or in the wiper preparation, a position of the wiping portion 301*a* of the wiper 301 may be moved and adjusted in the direction along the movement direction A.

Also in the present exemplary embodiment, the recording device 400 includes the helical spring 371 configured to bias the holding portion 702 such that the wiper 301 comes into contact with the outer circumferential surface 33*a* while the holding portion 702 is supported movably in the movement direction A by the support portion 703, and the fixing screw 351 configured to fix the holding portion 702 to the support portion 703. According to this configuration, when the contact state of the wiper 301 with the outer circumferential surface 33*a* by the helical spring 371 is unstable, fixing the holding portion 702 to the support portion 703 by the fixing screw 351 can reduce instability of the contact state of the wiper 301 with the outer circumferential surface 33*a*, and the outer circumferential surface 33*a* can be wiped.

3. Third Exemplary Embodiment

In a recording device 500 according to the third exemplary embodiment, the cleaning unit 80 according to the above-described first exemplary embodiment is changed to a cleaning unit 580. Further, in the cleaning unit 580, the wiper unit 83 according to the above-described first exemplary embodiment is changed to a wiper unit 583. Note that the same components as in the first exemplary embodiment are given the same reference signs, and redundant descriptions of these components will be omitted.

In the wiper unit 583, the holding portion 302, the support portion 303, and the helical spring 371 of the wiper unit 83 are changed to a holding portion 802, a support portion 803, and a helical spring 871, and the helical spring 871 is a tension coil spring.

Figure 10:
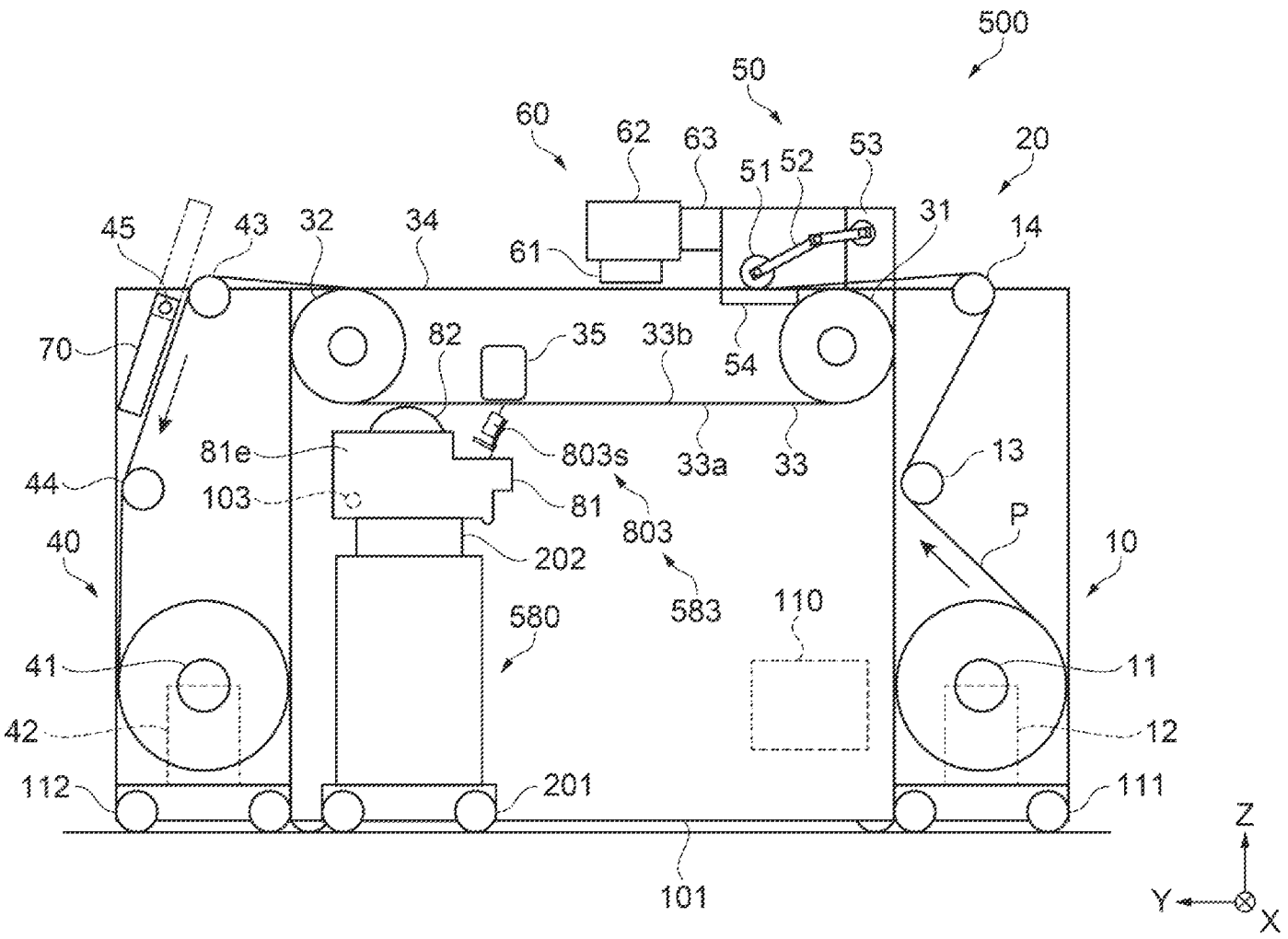
FIG. 10 is a schematic side view illustrating a schematic configuration of a recording device according to a third exemplary embodiment.
Figure 11A:
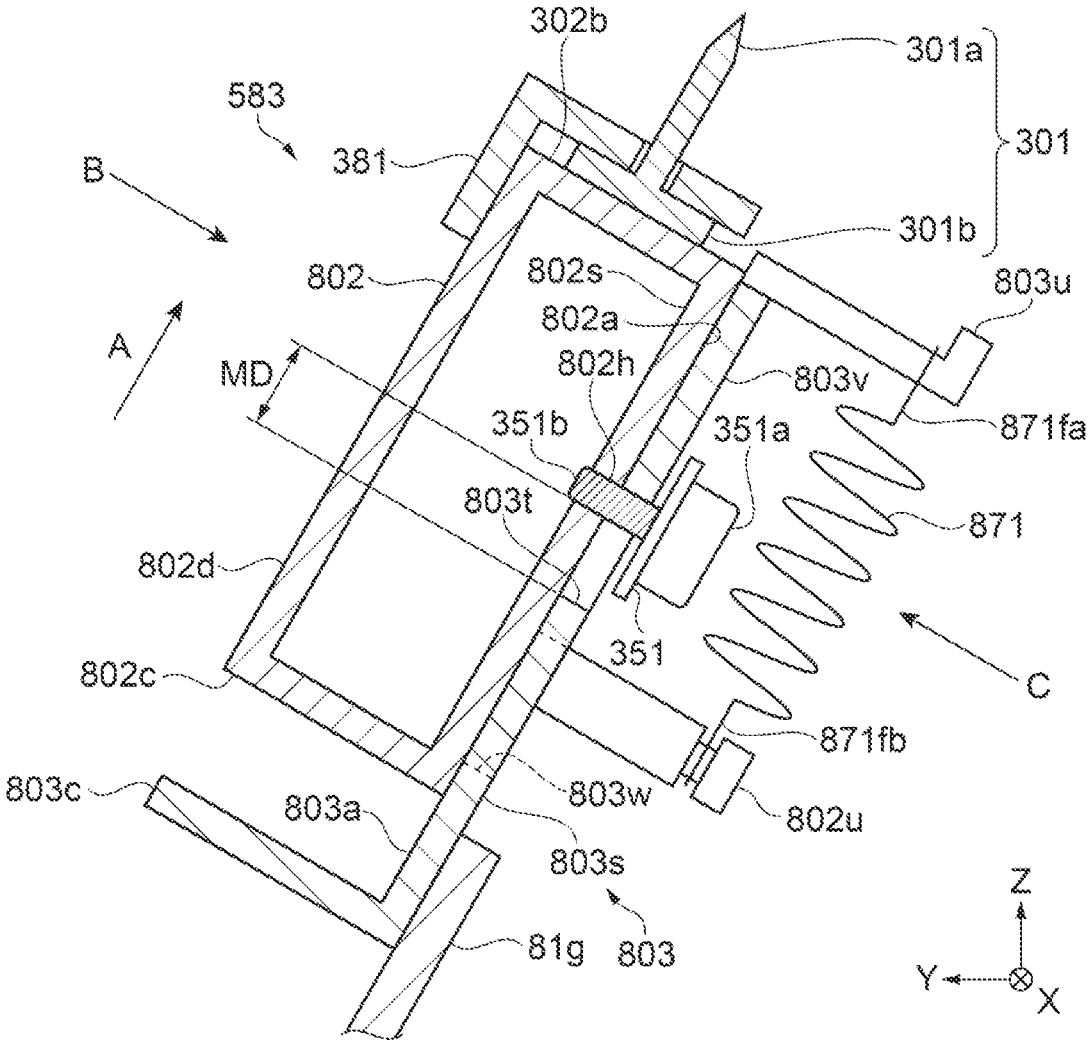
FIG. 11A is a schematic cross-sectional view of a wiper unit according to the third exemplary embodiment.
Figure 11B:
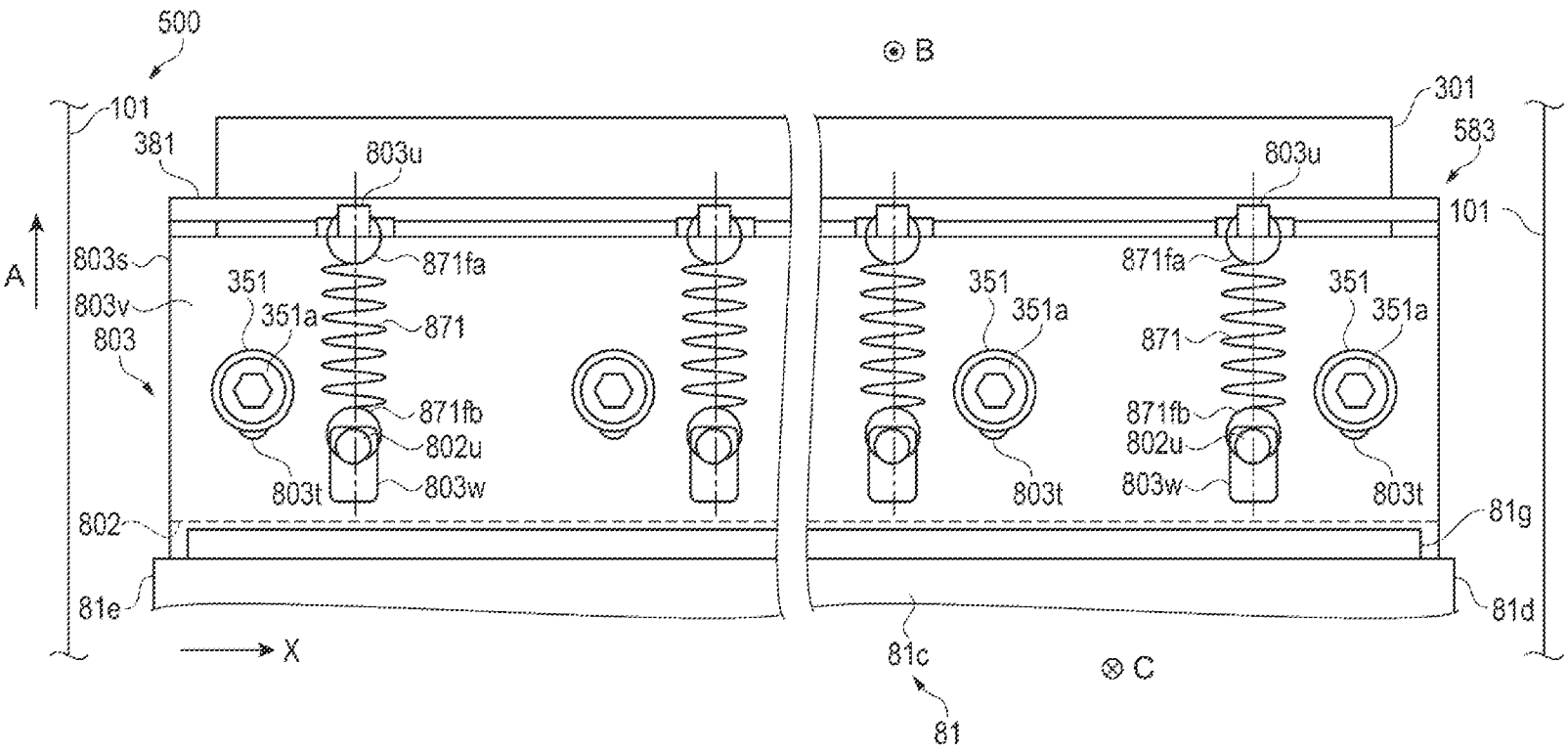
FIG. 11B is a plan view when viewed from a direction C in FIG. 11A.

As illustrated in FIGS. 10 to 11B, the support portion 803 includes an access portion 803*s* accessible from the −Y direction side that is the rear of the recording device 500 while the cleaning tank 81 of the cleaning unit 580 is positioned on the body frame 101 and is located below the outer circumferential surface 33*a* of the transporting belt 33. A direction C is a direction opposite to the direction B. The access portion 803*s* is accessible from the −Y direction side that is the rear of the recording device 500 by removing the medium supply unit 10 from the body frame 101. Thus, as illustrated in FIG. 11B, the support portion 803 and the access portion 803*s* included in the support portion 803 according to the present exemplary embodiment do not protrude to the outside of the cleaning tank 81 in the X direction from the side wall 81*d* and the side wall 81*e* of the cleaning tank 81 in a state where the support portion 803 is fixed to the plate member 81*g*.

The support portion 803 includes a plurality of the access portions 803*s* including at least both end portions in the width direction of the support portion 803 being the X direction in the state where the support portion 803 is fixed to the plate member 81*g*. The support portion 803 includes, on the access portion 803*s*, a support surface 803*a* that supports the holding portion 802 movably in the movement direction A. Provided that a surface of the access portion 803*s* on the rear side of the recording device 500 is an access surface 803*v*, the support surface 803*a* is a surface on the opposite side of the access surface 803*v*. The access portion 803*s* has a through hole 803*t* that extends through the access surface 803*v* and the support surface 803*a* in the direction B. The through hole 803*t* has an outer diameter larger than that of the fixing screw 351, and has a shape that does not allow the head portion 351*a* of the fixing screw 351 to pass through the through hole 803*t*.

A spring hanging portion 803*u* on which a hook 871*fa* of the helical spring 871 is hung is provided on the access surface 803*v* side of the support portion 803. As illustrated in FIG. 11B, at least one spring hanging portion 803*u* is provided in a position between the through holes 803*t* provided in the access portions 803*s* at both ends in the width direction of the support portion 803. In the present exemplary embodiment, two spring hanging portions 803*u* are provided on the access portions 803*s* at both ends in the width direction of the support portion 803. As illustrated in FIGS. 11A and 11B, the support portion 803 has, in a position on the upstream side of the spring hanging portion 803*u* in the movement direction A, a through hole 803*w* that extends through the access surface 803*v*, the support surface 803*a*, and the support portion 803 in the direction B. In other words, the same number of the through hole 803*w* as that of the spring hanging portion 803*u* is provided.

As illustrated in FIGS. 11A and 11B, in the holding portion 802, the fixed portion 302*s*, the sliding surface 302*a*, the rear end portion 302*c*, and the coupling portion 302*d* of the holding portion 302 according to the first exemplary embodiment are changed to a fixed portion 802*s*, a sliding surface 802*a*, a rear end portion 802*c*, and a coupling portion 802*d*. In the fixed portion 802*s* and the sliding surface 802*a*, the through hole 302*t* of the fixed portion 302*s* and the sliding surface 302*a* according to the first exemplary embodiment is changed to a screw hole 802*h*, and a spring hanging portion 802*u* is provided on the sliding surface 302*a*. The rear end portion 802*c* is obtained by excluding the through hole 302*e* from the rear end portion 302*c* according to the first exemplary embodiment. The coupling portion 802*d* is obtained by excluding the through hole 302*f* from the coupling portion 302*d* according to the first exemplary embodiment. The fixed portion 802*s* is provided in a position corresponding to the access portion 803*s* of the support portion 803. The screw hole 802*h* is provided in a position corresponding to the through hole 803*t* of the support portion 803. A hook 871*fb* of the helical spring 871 is hung on the spring hanging portion 802*u*. The spring hanging portion 802*u* is a pin provided in a position corresponding to the through hole 803*w* of the support portion 803, and protruding from the sliding surface 802*a*. A pin diameter of the spring hanging portion 802*u* is smaller than a diameter of the through hole 803*w*.

By screwing the fixing screw 351 into the screw hole 802*h* provided in the fixed portion 802*s* of the holding portion 802 with the fixing screw 351 inserted through the through hole 803*t* of the support portion 803 from the access surface 803*v* side, the fixed portion 802*s* becomes tightened and fixed to the support portion 803 sandwiched between the head portion 351*a* of the fixing screw 351 and the fixed portion 802*s*. In other words, by screwing the fixing screw 351 into the screw hole 802*h* with the fixing screw 351 inserted through the through hole 803*t*, the holding portion 802 becomes fixed to the support portion 803 sandwiched between the head portion 351*a* of the fixing screw 351 and the holding portion 802. At this time, the wiper 301 enters the fixed state where the wiper 301 does not move in the movement direction A. By rotating the fixing screw 351 and loosening the fixing screw 351, the sliding surface 802*a* can slide with respect to the support surface 803*a*, and the holding portion 802 enters a state of being supported movably in the movement direction A by the support portion 803. The moving amount MD in which the holding portion 802 is movable in the movement direction A with respect to the support portion 803 is increased by making a size of the through hole 803*t* larger than the outer diameter of the fixing screw 351 and making a size of the through hole 803*w* larger than the pin diameter of the spring hanging portion 802*u*.

For example, when a position of the holding portion 802 in the X direction being the width direction of the transporting belt 33 with respect to the support portion 803 is defined by the outer diameter of the fixing screw 351 and the through hole 803*t*, a shape of the through hole 803*t* may be set as an elongated hole shape having a dimension in the direction along the movement direction A greater than a dimension in the X direction.

In a support state where the support portion 803 supports the holding portion 802, the spring hanging portion 802*u* of the holding portion 802 is located upstream of the spring hanging portion 803*u* of the support portion 803 in the movement direction A. In the support state, the hook 871*fa* of the helical spring 871 is hung on the spring hanging portion 803*u* of the support portion 803, and the hook 871*fb* of the helical spring 871 is hung on the spring hanging portion 802*u* of the holding portion 802, and thus the helical spring 871 pulls the holding portion 802 in the movement direction A while the holding portion 802 is supported movably in the movement direction A by the support portion 803. In other words, the helical spring 871 biases the holding portion 802 such that the wiping portion 301*a* of the wiper 301 can come into contact with the outer circumferential surface 33*a* of the transporting belt 33 while the holding portion 802 is supported movably in the movement direction A by the support portion 803. In the present exemplary embodiment, when the holding portion 802 is biased in the movement direction A by the helical spring 871 while the holding portion 802 is supported movably in the movement direction A by the support portion 803 and the wiping portion 301*a* is not in contact with the outer circumferential surface 33*a* of the transporting belt 33, the holding portion 802 is in a biased state where the fixing screw 351 screwed into the screw hole 802*h* of the fixed portion 802*s* is pressed against a downstream end of the through hole 803*t* in the movement direction A. At this time, the wiping portion 301*a* of the wiper 301 is in a movable state where the wiping portion 301*a* is movable by the moving amount MD in the direction opposite to the movement direction A from a position in the biased state.

Figure 12A:
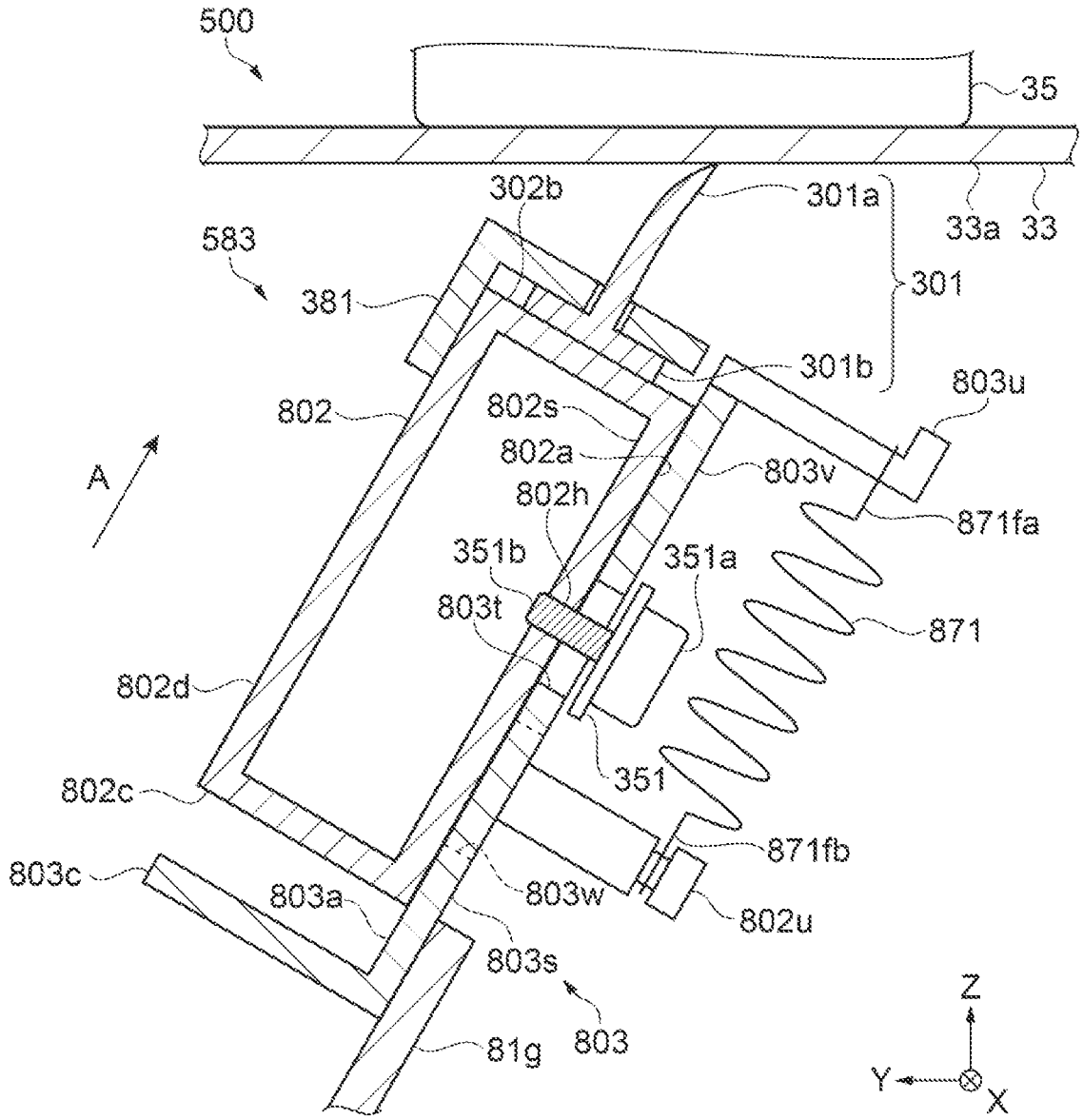
FIG. 12A is a schematic cross-sectional view of the wiper unit according to the third exemplary embodiment in a following wipeable state.

The cleaning unit 580 is disposed below the outer circumferential surface 33*a* of the transporting belt 33, and the control unit 110 drives the elevator mechanism 202, to move the wiping portion 301*a* of the wiper 301 in the movable state from the separated position to the cleaning position. As illustrated in FIG. 12A, when the wiping portion 301*a* is caused to come into contact with the outer circumferential surface 33*a* of the transporting belt 33, the wiping portion 301*a* of the wiper 301 enters a pressed state where the wiping portion 301*a* is pressed against the outer circumferential surface 33*a* of the transporting belt 33 in the movement direction A by the predetermined load PL.

At this time, in the cleaning position in which the outer circumferential surface 33*a* of the transporting belt 33 can be wiped, the wiping portion 301*a* of the wiper 301 is pressed against the outer circumferential surface 33*a* of the transporting belt 33 in the movement direction A by the predetermined load PL, and also enters the following wipeable state where the wiping portion 301*a* is movable in the movement direction A. In this state, the control unit 110 rotationally drives the belt driving roller 32 to move the outer circumferential surface 33*a* of the transporting belt 33, and thus the recording device 500 can perform a following wiping operation of wiping the outer circumferential surface 33*a* of the transporting belt 33 by the wiping portion 301*a* of the wiper 301 in the following wipeable state. Note that the predetermined load PL can be changed by, for example, replacing the helical spring 871 with a helical spring having a specification different from that of the helical spring 871.

Figure 12B:
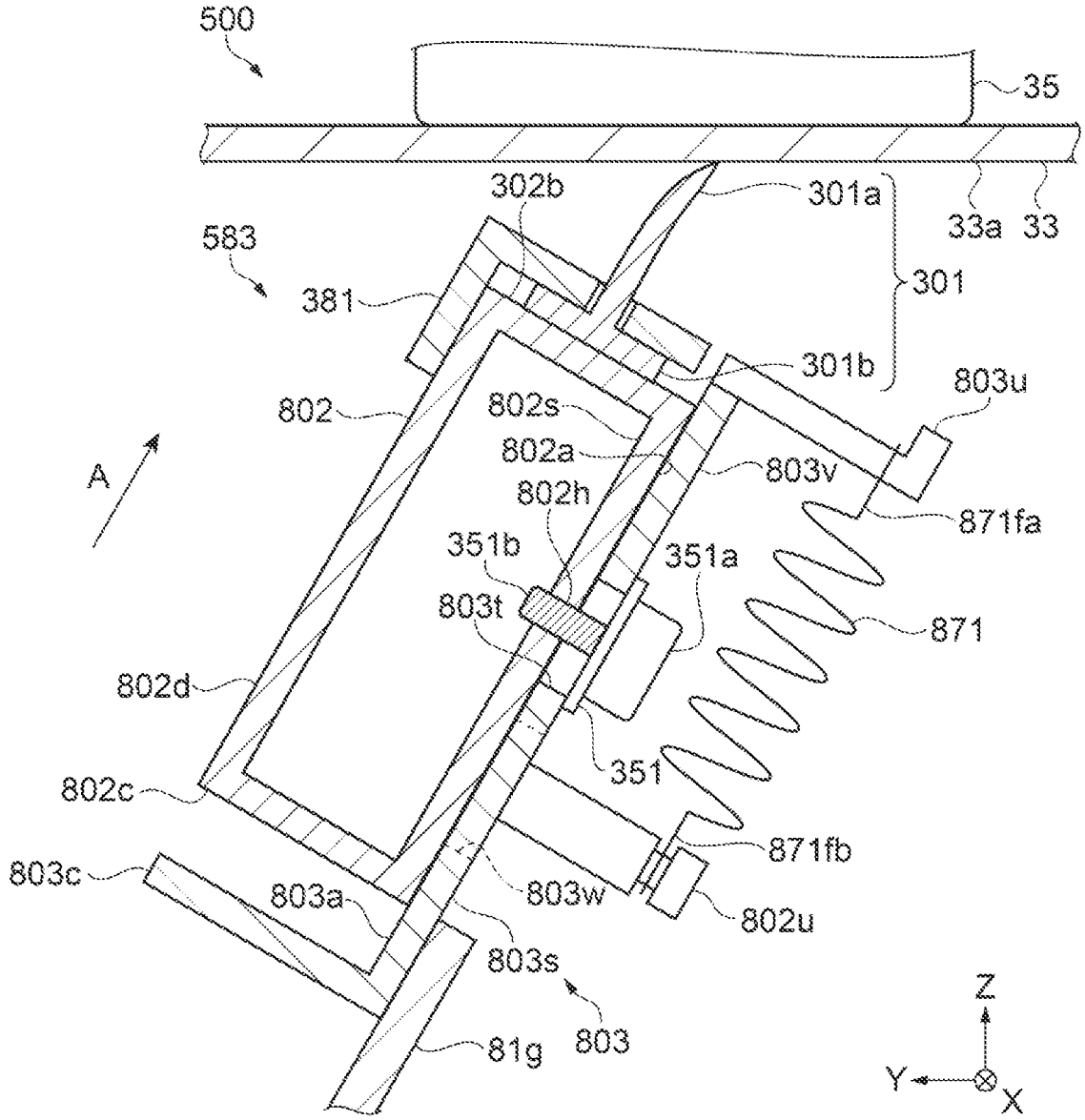
FIG. 12B is a schematic cross-sectional view of the wiper unit according to the third exemplary embodiment in a fixed wipeable state.

Further, in the present exemplary embodiment, the head portion 351*a* of the fixing screw 351 screwed into the screw hole 802*h* of the fixed portion 802*s* in the holding portion 802, and the helical spring 871 are located on the access surface 803*v* side of the support portion 803 accessible from the −Y direction side that is the rear of the recording device 500 while the cleaning unit 580 is positioned on the body frame 101 and is located below the outer circumferential surface 33*a* of the transporting belt 33. Thus, in the cleaning position, the access surface 803*v* side can be accessed from the rear of the recording device 500, and, as illustrated in FIG. 12B, the holding portion 802 with the wiping portion 301*a* of the wiper 301 in the pressed state can be tightened and fixed to the support portion 803 by the fixing screw 351. In this way, in the cleaning position in which the outer circumferential surface 33*a* of the transporting belt 33 can be wiped, the wiping portion 301*a* of the wiper 301 can be pressed against the outer circumferential surface 33*a* of the transporting belt 33 in the movement direction A by the predetermined load PL, and can be brought into the fixed wipeable state where the wiping portion 301*a* does not move in the movement direction A. In this state, the control unit 110 rotationally drives the belt driving roller 32 to move the outer circumferential surface 33*a* of the transporting belt 33, and thus the recording device 500 can perform a fixed wiping operation of wiping the outer circumferential surface 33*a* of the transporting belt 33 by the wiping portion 301*a* of the wiper 301 in the fixed wipeable state.

A method for adjusting the wiper 301 according to the present exemplary embodiment is the same as the method for adjusting the wiper 301 according to the first exemplary embodiment, but in the present exemplary embodiment, when the wiper fixing is performed in the cleaning position, the wiper unit 583 is accessed from the rear of the recording device 500.

Also in the present exemplary embodiment, the recording device 500 includes the helical spring 871 configured to bias the holding portion 802 such that the wiper 301 comes into contact with the outer circumferential surface 33*a* while the holding portion 802 is supported movably in the movement direction A by the support portion 803, and the fixing screw 351 configured to fix the holding portion 802 to the support portion 803. According to this configuration, when the contact state of the wiper 301 with the outer circumferential surface 33*a* by the helical spring 871 is unstable, fixing the holding portion 802 to the support portion 803 by the fixing screw 351 can reduce instability of the contact state of the wiper 301 with the outer circumferential surface 33*a*, and the outer circumferential surface 33*a* can be wiped.

The above-described exemplary embodiment and another exemplary embodiment described below may be implemented in combination within a range in which a technical contradiction does not arise. The other embodiment will be described below.

An adjustment of the wiper 301 may be performed in an adjustment position in which the cleaning tank is separated from the cleaning position in a direction different from the Y direction. For example, in the second exemplary embodiment, the belt support portion 35 is movable to a protruding position outside the recording device 400 separated in the −X direction from a position in which the belt support portion 35 supports the inside of the transporting belt 33. A guide direction of the guide rail that guides a movement of the cleaning unit 480 is changed to the X direction. When the adjustment of the wiper 301 is performed, the cleaning unit 480 is moved to a position that is separated in the −X direction from a position vertically below the transporting belt 33 and is vertically below the belt support portion 35 in the protruding position. Then, the elevator mechanism 202 is driven to move the cleaning tank 481 from the cleaning position to the adjustment position in the +Z direction by a thickness of the transporting belt 33, to perform the wiper fixing. According to this configuration, a distance in the Z direction between the support surface 35*a* of the belt support portion 35 in contact with the wiping portion 301*a* of the wiper 301 in the adjustment position, and the cleaning tank 481 in the adjustment position is substantially the same as a distance in the Z direction between the outer circumferential surface 33*a* of the transporting belt 33 in contact with the wiping portion 301*a* of the wiper 301 in the cleaning position, and the cleaning tank 481 in the cleaning position. Further, when the cleaning unit 480 is located in the adjustment position, the wiper unit 483 including the access portion 303*s* and the fixed portion 302*s* is located outside the accessible recording device 400. According to this configuration, the wiper fixing in the method for adjusting the wiper 301 can be performed in the adjustment position with substantially the same adjustment accuracy as that when the wiper fixing is performed in the cleaning position.

In any of the first exemplary embodiment to the third exemplary embodiment, in the cleaning position in which the wiping portion 301*a* of the wiper 301 is pressed against the outer circumferential surface 33*a* of the transporting belt 33, the wiper fixing in the method for adjusting the wiper 301 may be performed while the belt driving roller 32 is rotationally driven and the outer circumferential surface 33*a* of the transporting belt 33 is moved. Further, in any of the first exemplary embodiment and the third exemplary embodiment, in the cleaning position in which the wiping portion 301*a* of the wiper 301 is pressed against the outer circumferential surface 33*a* of the transporting belt 33, the wiper fixing in the method for adjusting the wiper 301 may be performed while the cleaning brush 82 is rotationally driven to perform cleaning of the transporting belt 33 and the outer circumferential surface 33*a* of the transporting belt 33 is moved. According to this configuration, the wiper fixing can be performed while confirming a wiping condition of the outer circumferential surface 33*a* by the wiper 301. The pressing load on the outer circumferential surface 33*a* of the wiper 301 may be changed based on a confirmation result of the wiping condition.

In the first exemplary embodiment, after the holding portion 302 is fixed to the support portion 303 by the fixing portion, the helical spring 371 may be removed from the disposed position between the upright portion 303*c* and the rear end portion 302*c*.

The insertion portion may not be the second screw 352. For example, in the first exemplary embodiment, the insertion portion may be another member having a pin shape that is press-fitted in the through hole provided in the upright portion 303*c*, or the support portion 303 may be formed of a sheet metal member and the insertion portion may be formed by being bent and raised from the upright portion 303*c*.

The extending direction in which the wiping portion 301*a* of the wiper 301 extends from the base portion 301*b* toward the outer circumferential surface 33*a* of the transporting belt 33 may not be inclined such that the tip of the wiping portion 301*a* is located downstream of the rear end of the wiping portion 301*a* on the base portion 301*b* side in the movement direction of the outer circumferential surface 33*a* in contact with the wiper 301. For example, in the first exemplary embodiment, the extending direction in which the wiping portion 301*a* of the wiper 301 extends from the base portion 301*b* toward the outer circumferential surface 33*a* of the transporting belt 33 may be perpendicular to the outer circumferential surface 33*a* of the transporting belt 33.

The movement direction when the support portion of the wiper unit supports the holding portion movably in the movement direction of the wiper toward the outer circumferential surface of the transporting belt may not be the same as the extending direction of the wiping portion of the wiper. For example, in the first exemplary embodiment, the extending direction of the wiping portion 301*a* of the wiper 301 may be inclined such that the tip of the wiping portion 301*a* is located downstream of the rear end of the wiping portion 301*a* on the base portion 301*b* side in the movement direction of the outer circumferential surface 33*a* in contact with the wiper 301, and the movement direction A when the support portion 303 supports the holding portion 302 movably in the movement direction A of the wiper 301 toward the outer circumferential surface 33*a* of the transporting belt 33 may be perpendicular to the outer circumferential surface 33*a* of the transporting belt 33.

The elastic member may not be the helical spring 371. For example, in the second exemplary embodiment, the elastic member may be a torsion coil spring, a plate spring, or a rubber spring disposed between the upright portion 303*c* and the rear end portion 302*c* in the movement direction A in the support state.

The fixing portion may not be a screw. For example, in the first exemplary embodiment, the fixing portion may be a tightening member attached rotatably about the axis to the access portion 303*s* of the support portion 303. In this case, the tightening member may include a cam surface including a protruding portion in contact with the fixed portion 302*s* of the holding portion 302 and a non-contact portion that is not in contact with the fixed portion 302*s*, and may be formed of a rotation cam portion that can switch, by rotating about the axis, between a fixing position in which the fixed portion 302*s* is sandwiched and fixed between a protruding portion and the support portion 303 and a movable position in which the fixed portion 302*s* is located between a recessed portion and the support portion 303, and a lever that can rotate the rotation cam portion about the axis. In other words, a structure of the fixing portion is not limited thereto as long as a mechanism has a function of fixing the holding portion 302 to the support portion 303.

In the first exemplary embodiment, the medium collection unit 40 may not be removed from the recording device 100 to access the access region AA. For example, by moving the drying unit 70 to the maintenance position while the medium collection unit 40 is attached to the recording device 100, the access region AA may be accessed from the +Y direction side that is the front of the recording device 100.

What is claimed is:

1. A recording device, comprising:

a recording unit configured to perform recording on a medium;

a transporting belt having an outer circumferential surface that supports the medium, and configured to transport the medium in a transport direction;

a wiper configured to wipe the outer circumferential surface by coming into contact with the outer circumferential surface, the wiper extending in a width direction of the transporting belt, the width direction perpendicular to the transport direction;

a holding portion configured to hold the wiper;

a support portion configured to support the holding portion slidably in a linear movement direction in which the wiper linearly moves toward the outer circumferential surface while an inclination angle of the wiper remains the same;

an elastic member configured to bias the holding portion such that the wiper comes into contact with the outer circumferential surface while the holding portion is supported movably in the movement direction by the support portion; and a fixing portion configured to fix the holding portion to the support portion.

2. The recording device according to claim 1, wherein the support portion includes a support surface along the linear movement direction, the holding portion includes a sliding surface that slides with respect to the support surface, the support surface has a screw hole, the holding portion has a first hole that extends through the sliding surface and the holding portion, and the fixing portion is a screw, and the holding portion sandwiched between a head portion of the screw and the support portion is fixed to the support portion by screwing the screw into the screw hole while the screw is inserted through the first hole larger than an outer diameter of the screw.

3. The recording device according to claim 2, wherein the holding portion includes a rear end portion opposite to a tip portion to which the wiper is attached in the linear movement direction, the support portion includes an upright portion provided upstream of the rear end portion in the linear movement direction, and the elastic member is disposed between the upright portion and the rear end portion in the linear movement direction.

4. The recording device according to claim 3, wherein the elastic member is a helical spring, and the upright portion is provided with an insertion portion inserted through an inner circumference of the helical spring.

5. The recording device according to claim 4, wherein the insertion portion is a second screw configured to be screwed into a second screw hole provided in the upright portion.

6. The recording device according to claim 4, wherein the rear end portion has a through hole through which the insertion portion is inserted.

7. A recording device, comprising:

a recording unit configured to perform recording on a medium;

a transporting belt having an outer circumferential surface that supports the medium, and configured to transport the medium;

a wiper configured to wipe the outer circumferential surface by coming into contact with the outer circumferential surface;

a holding portion configured to hold the wiper;

a support portion configured to support the holding portion movably in a movement direction in which the wiper moves toward the outer circumferential surface;

an elastic member configured to bias the holding portion such that the wiper comes into contact with the outer circumferential surface while the holding portion is supported movably in the movement direction by the support portion; and a fixing portion configured to fix the holding portion to the support portion, wherein the support portion includes a support surface along the movement direction, the holding portion includes a sliding surface that slides with respect to the support surface, the support surface has a screw hole, the holding portion has a first hole that extends through the sliding surface and the holding portion, and the fixing portion is a screw, and the holding portion sandwiched between a head portion of the screw and the support portion is fixed to the support portion by screwing the screw into the screw hole while the screw is inserted through the first hole larger than an outer diameter of the screw.

8. The recording device according to claim 7, wherein the holding portion includes a rear end portion opposite to a tip portion to which the wiper is attached in the movement direction, the support portion includes an upright portion provided upstream of the rear end portion in the movement direction, and the elastic member is disposed between the upright portion and the rear end portion in the movement direction.

9. The recording device according to claim 8, wherein the elastic member is a helical spring, and the upright portion is provided with an insertion portion inserted through an inner circumference of the helical spring.

10. The recording device according to claim 9, wherein the insertion portion is a second screw configured to be screwed into a second screw hole provided in the upright portion.

11. The recording device according to claim 9, wherein the rear end portion has a through hole through which the insertion portion is inserted.

* * * * *